US011944248B2

(12) United States Patent
Terry et al.

(10) Patent No.: US 11,944,248 B2
(45) Date of Patent: Apr. 2, 2024

(54) SURFACE CLEANING DEVICE WITH AUTOMATED CONTROL

(71) Applicant: TECHTRONIC FLOOR CARE TECHNOLOGY LIMITED, Tortola (VG)

(72) Inventors: Kevin Terry, Charlotte, NC (US); Patrick Diana, Davidson, NC (US); Douglas M. Rukavina, Concord, NC (US)

(73) Assignee: TECHTRONIC FLOOR CARE TECHNOLOGY LIMITED, Tortola (VG)

( * ) Notice: Subject to any disclaimer, the term of this patent is extended or adjusted under 35 U.S.C. 154(b) by 0 days.

(21) Appl. No.: 17/839,084

(22) Filed: Jun. 13, 2022

(65) Prior Publication Data

US 2022/0304534 A1 Sep. 29, 2022

Related U.S. Application Data

(63) Continuation of application No. 16/688,262, filed on Nov. 19, 2019, now Pat. No. 11,382,477, which is a (Continued)

(51) Int. Cl.
*A47L 11/40* (2006.01)
*A47L 5/36* (2006.01)

(Continued)

(52) U.S. Cl.
CPC ..... *A47L 11/4011* (2013.01); *A47L 5/365* (2013.01); *A47L 7/0009* (2013.01); *A47L 7/0023* (2013.01);

(Continued)

(58) Field of Classification Search
CPC .. A47L 9/2805; A47L 11/4011; A47L 9/2842; A47L 9/0494; A47L 5/34
See application file for complete search history.

(56) References Cited

U.S. PATENT DOCUMENTS 1,380,163 A 5/1921 Spielman
2,148,656 A 2/1939 Smellie (Continued)

FOREIGN PATENT DOCUMENTS

CN 1550198 A 12/2004
CN 105361822 A 3/2016

(Continued)

OTHER PUBLICATIONS

Office Action completed Feb. 24, 2022 for Chinese Patent Application No. 201980088191.2.

(Continued)

*Primary Examiner* — Andrew A Horton
(74) *Attorney, Agent, or Firm* — Moore & Van Allen PLLC; R. W. McCord Rayburn

(57) ABSTRACT

A surface cleaner is provided. The surface cleaner comprises: an operating component configured to perform a function of the surface cleaner; a base moveable along a surface; an accelerometer configured to generate a signal; and a controller in communication with the accelerometer and the operating component, wherein the controller is operable to control the operating component based on the signal, and wherein the operating component is selected from a group consisting of a suction motor operable to generate an airflow, a brushroll motor operable to drive a brushroll, an actuator operable to adjust a height of a brushroll from the surface, a pump operable to deliver a (Continued)

cleaning fluid, an actuator operable to control an airflow or fluid valve, and an indicator operable to indicate a parameter of the surface cleaner.

21 Claims, 11 Drawing Sheets

Related U.S. Application Data continuation-in-part of application No. 16/220,757, filed on Dec. 14, 2018, now Pat. No. 11,395,571.

(60) Provisional application No. 62/769,348, filed on Nov. 19, 2018, provisional application No. 62/607,099, filed on Dec. 18, 2017.

(51) Int. Cl.
*A47L 7/00* (2006.01)
*A47L 9/28* (2006.01)
*A47L 11/30* (2006.01)

(52) U.S. Cl.
CPC ..... *A47L 9/2805* (2013.01); *A47L 9/2842* (2013.01); *A47L 9/2847* (2013.01); *A47L 11/302* (2013.01); *A47L 11/4016* (2013.01); *A47L 11/4044* (2013.01); *A47L 11/4072* (2013.01); *A47L 11/4083* (2013.01); *A47L 11/4088* (2013.01)

(56) References Cited

U.S. PATENT DOCUMENTS

| | | | | |
|---|---|---|---|---|
| 3,715,775 | A | 2/1973 | Nickelson | |
| 4,196,492 | A * | 4/1980 | Johnson | A47L 11/4088 15/340.1 |
| 4,558,823 | A | 12/1985 | Groth | |
| 5,014,388 | A | 5/1991 | Schiazza et al. | |
| 5,115,538 | A | 5/1992 | Cochran et al. | |
| 5,748,853 | A | 5/1998 | Deschenes | |
| 5,881,430 | A | 3/1999 | Driessen et al. | |
| 6,061,869 | A | 5/2000 | Ettes et al. | |
| 6,108,862 | A | 8/2000 | Frederick | |
| 6,131,238 | A | 10/2000 | Weber | |
| 6,363,571 | B1 | 4/2002 | Block et al. | |
| 6,421,862 | B2 | 7/2002 | Lesco et al. | |
| 6,446,302 | B1 | 9/2002 | Kasper et al. | |
| 6,457,205 | B1 | 10/2002 | Conrad | |
| 6,526,622 | B2 | 3/2003 | Conrad | |
| 6,681,442 | B2 | 1/2004 | Coates et al. | |
| 6,800,140 | B2 | 10/2004 | Hansen | |
| 6,832,407 | B2 | 12/2004 | Salem et al. | |
| 7,000,285 | B2 | 2/2006 | Conner et al. | |
| 7,043,794 | B2 | 5/2006 | Conner et al. | |
| 7,062,816 | B2 | 6/2006 | Kasper et al. | |
| 7,076,830 | B2 | 7/2006 | Conner et al. | |
| 7,146,679 | B2 | 12/2006 | Kellum et al. | |
| 7,203,993 | B2 | 4/2007 | Tondra et al. | |
| 7,208,892 | B2 | 4/2007 | Tondra et al. | |
| 7,222,390 | B2 | 5/2007 | Cipolla et al. | |
| 7,237,298 | B2 | 7/2007 | Reindle et al. | |
| 7,237,299 | B2 | 7/2007 | Tondra et al. | |
| 7,269,877 | B2 | 9/2007 | Tondra et al. | |
| 7,362,064 | B2 | 4/2008 | Kellum et al. | |
| 7,367,080 | B2 | 5/2008 | Lim et al. | |
| 7,392,566 | B2 | 7/2008 | Gordon et al. | |
| 7,418,764 | B2 | 9/2008 | Gordon et al. | |
| 7,424,766 | B2 | 9/2008 | Reindle et al. | |
| 7,599,758 | B2 | 10/2009 | Reindle et al. | |
| 7,617,563 | B2 | 11/2009 | Hertrick et al. | |
| 7,725,223 | B2 | 5/2010 | Gordon et al. | |
| 7,757,342 | B2 | 7/2010 | Gordon et al. | |
| 7,758,702 | B1 | 7/2010 | Huffman | |
| 7,904,990 | B1 | 3/2011 | Miner | |
| 8,349,088 | B1 | 1/2013 | Miner | |
| 8,789,235 | B2 | 7/2014 | Krebs et al. | |
| 8,800,106 | B2 | 8/2014 | Bilek et al. | |
| 9,055,848 | B2 | 6/2015 | Liu et al. | |
| 10,602,900 | B2 | 3/2020 | Koetz et al. | |
| 10,813,521 | B2 | 10/2020 | Diana et al. | |
| 10,820,770 | B2 | 11/2020 | Diana et al. | |
| 10,827,900 | B2 | 11/2020 | Huffman et al. | |
| 11,122,952 | B2 | 9/2021 | Diana et al. | |
| 11,382,477 | B2 | 7/2022 | Terry et al. | |
| 11,395,571 | B2 | 7/2022 | Diana et al. | |
| 2001/0039684 | A1 | 11/2001 | Kasper et al. | |
| 2004/0000023 | A1 | 1/2004 | Hitzelberger et al. | |
| 2004/0010884 | A1 | 1/2004 | Hitzelberger | |
| 2004/0177473 | A1 | 9/2004 | Abdallah et al. | |
| 2004/0221415 | A1 | 11/2004 | Tondra et al. | |
| 2005/0071056 | A1 | 3/2005 | Tondra et al. | |
| 2006/0288517 | A1 | 12/2006 | Oh et al. | |
| 2008/0276408 | A1 | 11/2008 | Gilbert, Jr. et al. | |
| 2009/0165822 | A1 | 7/2009 | Kintz et al. | |
| 2010/0257691 | A1 | 10/2010 | Jones et al. | |
| 2013/0180055 | A1 * | 7/2013 | Haley | A47L 11/34 8/137 |
| 2014/0259510 | A1 | 9/2014 | Conrad | |
| 2014/0283332 | A1 | 9/2014 | Conrad et al. | |
| 2015/0272412 | A1 * | 10/2015 | Liscio | A47L 11/4011 134/6 |
| 2016/0037983 | A1 | 2/2016 | Hillen et al. | |
| 2016/0235268 | A1 | 8/2016 | Choi et al. | |
| 2016/0235270 | A1 | 8/2016 | Santini | |
| 2016/0309973 | A1 * | 10/2016 | Sheikh | A47L 11/4072 |
| 2017/0344019 | A1 | 11/2017 | Haegermarck et al. | |
| 2018/0249875 | A1 | 9/2018 | Hooley et al. | |
| 2019/0082915 | A1 | 3/2019 | Conrad | |
| 2019/0290089 | A1 | 9/2019 | Johnson et al. | |
| 2019/0343360 | A1 | 11/2019 | Diana et al. | |
| 2019/0365177 | A1 | 12/2019 | Gordon et al. | |
| 2020/0054181 | A1 | 2/2020 | Rukavina | |
| 2022/0304534 | A1 | 9/2022 | Terry et al. | |

FOREIGN PATENT DOCUMENTS

| | | | | |
|---|---|---|---|---|
| CN | 107041716 | A | 8/2017 | |
| DE | 102015100636 | A1 | 7/2016 | |
| DE | 102015108464 | A1 | 12/2016 | |
| DE | 102016210939 | A1 | 12/2017 | |
| DE | 102018209385 | A1 | 12/2019 | |
| EP | 458057 | A1 | 11/1991 | |
| EP | 2682034 | A2 | 1/2014 | |
| EP | 3054827 | A1 | 8/2016 | |
| EP | 3205252 | A1 | 8/2017 | |
| FR | 1207569 | A | 2/1960 | |
| GB | 162777 | A | 5/1921 | |
| GB | 2485666 | A | 5/2012 | |
| GB | 2554780 | A | 4/2018 | |
| GB | 2554780 | A * | 4/2018 | A47L 5/22 |
| JP | 05220064 | A | 8/1993 | |
| JP | 05228073 | A | 9/1993 | |
| JP | 2009172235 | A | 8/2009 | |
| JP | 2011030668 | A | 2/2011 | |
| KR | 19980035123 | U | 9/1998 | |
| TW | 200924688 | A | 6/2009 | |

OTHER PUBLICATIONS

First Office Action completed Apr. 16, 2021 for Chinese Patent Application No. 201880089636.4.

International Search Report and Written Opinion for International Application No. PCT/US2019/058804 completed Feb. 5, 2020.

International Search Report and Written Opinion for International Patent Application No. PCT/US2018/065754 dated Jun. 12, 2019.

Hoover Platinum Collection F8100900 Owner's Manual, #960009435-01 Nov. 2008; 48 pages www.hoover.com.

First Office Action dated Jul. 25, 2022 for Chinese Patent Application No. 202111578155.X.

Examination report for European patent Application No. 18833565.7 dated Jul. 12, 2022.

(56) References Cited

OTHER PUBLICATIONS

Examination report for Australian patent Application No. 2019383859 dated Nov. 15, 2022.
Examination report for Australian patent Application No. 2019383859 dated Aug. 17, 2022.
Automation Products Group (APG), "Understanding Ultrasonic Transducers", Screenshot of website taken Nov. 2, 2023 (Year: 2023).

* cited by examiner

SURFACE CLEANING DEVICE WITH AUTOMATED CONTROL

CROSS-REFERENCE TO RELATED APPLICATIONS

This application is a continuation of U.S. patent application Ser. No. 16/688,262, filed Nov. 19, 2019 (and published May 21, 2020, as U.S. Patent Application Publication No. 2020/0154968), which is a continuation-in-part of U.S. patent application Ser. No. 16/220,757, filed Dec. 14, 2018 (and published Jun. 20, 2019, as U.S. Patent Application Publication No. 2019/0183311), which claims benefit of U.S. Provisional Application No. 62/607,099, filed Dec. 18, 2017. U.S. patent application Ser. No. 16/688,262 also claims the benefit of U.S. Provisional Patent Application No. 62/769,348, filed Nov. 19, 2018. Each of the foregoing patent applications and patent publications is hereby incorporated by reference herein in its entirety.

BACKGROUND

Surface cleaning devices, such as dry vacuums and wet extractors, are used to remove dirt, and other various debris from a surface, such as a carpet or hard floor. Typically, surface cleaners rely on a user to directly activate an operating component (e.g., cleaning liquid distributor, brushroll height adjustor, etc.) of the surface cleaning device via a mechanism, such as by the user pressing or holding a button, trigger, interacting with an interface, or the like. Relying on user interaction for control of certain operating components of the surface cleaner can lead to inefficient operation of the device and potentially damage to a surface being cleaned. Furthermore, actuation of a trigger, button, or other user interface during prolonged use of the surface cleaner may lead to user fatigue.

BRIEF SUMMARY

A surface cleaner is provided. The surface cleaner comprises: an operating component configured to perform a function of the surface cleaner; a base moveable along a surface; an accelerometer configured to generate a signal; and a controller in communication with the accelerometer and the operating component, wherein the controller is operable to control the operating component based on the signal, and wherein the operating component is selected from a group consisting of a suction motor operable to generate an airflow, a brushroll motor operable to drive a brushroll, an actuator operable to adjust a height of a brushroll from the surface, a pump operable to deliver a cleaning fluid, an actuator operable to control an airflow or fluid valve, and an indicator operable to indicate a parameter of the surface cleaner.

In a particular embodiment, the operating component is at least one selected from the pump operable to deliver a cleaning fluid and the actuator operable to control a fluid valve, the surface cleaner further comprising: a handle configured to be gripped by a user to move the base along the surface to be cleaned; and a liquid distribution system including a supply tank and a distributor in fluid communication configured to deliver solution to the surface in a distributing mode and to not deliver the solution to the surface in a non-distributing mode, the liquid distribution system further including the operating component, wherein the accelerometer is further configured to generate an accelerometer signal as a first signal based on user-initiated movement of the base along the surface in a forward direction and as a second signal based on user-initiated movement of the base along the surface in a rearward direction, wherein the controller is operatively connected to the liquid distribution system, the controller being configured to operate the liquid distribution system based on the accelerometer signal and independent of user interaction with the surface cleaner other than the user-initiated movement, and wherein the accelerometer signal is indicative of direction of movement of the base and, optionally, speed of movement of the base.

In another embodiment, the operating component is at least one selected from the suction motor operable to generate an airflow and the actuator operable to control an airflow, the surface cleaner further comprising: a suction nozzle in fluid communication with the operating component configured to generate the airflow through the suction nozzle, wherein the accelerometer is further configured to generate an accelerometer signal as a first signal based on user-initiated movement of the base along the surface in a forward direction and as a second signal based on user-initiated movement of the base along the surface in a rearward direction, wherein the controller is operatively connected to the operating component, the controller being configured to operate the operating component to increase or decrease the airflow through the suction nozzle based on the accelerometer signal and independent of user interaction with the surface cleaner other than the user-initiated movement, and wherein the accelerometer signal is indicative of direction of movement of the base and, optionally, speed of movement of the base.

In yet another embodiment, the operating component is at least one selected from the brushroll motor operable to drive the brushroll and the actuator operable to adjust the height of the brushroll from the surface, wherein the accelerometer is further configured to generate an accelerometer signal as a first signal based on user-initiated movement of the base along the surface in a forward direction and as a second signal based on user-initiated movement of the base along the surface in a rearward direction, wherein the controller is operatively connected to the operating component, wherein the controller controls the operating component based on the accelerometer signal and independent of user interaction with the surface cleaner other than the user-initiated movement, and wherein the accelerometer signal is indicative of direction of movement of the base and, optionally, speed of movement of the base.

In yet another embodiment, the surface cleaner further comprises a The surface cleaner of claim 1 further comprising a handle pivotally coupled to the base, the handle positionable between a working position and an upright storage position, wherein the operating component is the indicator operable to indicate a parameter of the surface cleaner, wherein the accelerometer is further configured to generate the signal based on user-initiated movement of the base along the surface, wherein the controller is operatively connected to the indicator, the controller being configured to activate the indicator based on the signal during operation of the surface cleaner, and wherein the signal is indicative of one or more attributes selected from a group consisting of movement in a forward direction, movement in a reverse direction, speed of movement, and a position of the handle.

A surface cleaner is also provided. The surface cleaner comprises: a base movable along a surface to be cleaned; a handle configured to be gripped by a user to move the base along the surface to be cleaned; a nozzle in fluid communication with a suction motor configured to generate a suction airflow through the nozzle; an accelerometer operable to generate a signal based on a movement of the surface cleaner; and a controller operatively connected to the accelerometer and the suction motor, the controller being configured to control the suction airflow through the nozzle by controlling the suction motor based on the signal generated by the accelerometer, wherein the signal is indicative of one or more attributes selected from a group consisting of direction of movement of the base, speed of movement of the base, and a position of the handle.

The features, functions, and advantages that have been discussed may be achieved independently in various embodiments of the device and methods described herein or may be combined with yet other embodiments, further details of which can be seen with reference to the following description and drawings.

BRIEF DESCRIPTION OF DRAWINGS

The foregoing and other advantages and features of the disclosure, and the manner in which the same are accomplished, will become more readily apparent upon consideration of the following detailed description of the disclosure taken in conjunction with the accompanying drawings, which illustrate embodiments of the disclosure and which are not necessarily drawn to scale, wherein.

DETAILED DESCRIPTION

Embodiments of the present disclosure now may be described more fully hereinafter with reference to the accompanying drawings, in which some, but not all, embodiments of the disclosure are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together. Furthermore, operatively coupled components may mean that the components retain at least some freedom of movement in one or more directions or may be rotated about an axis (i.e., rotationally coupled). Furthermore, "operatively coupled" may mean that components may be electronically connected and/or in fluid communication with one another.

It should be understood that a "switch," as used herein, refers to any device used for completing or breaking an electrical or mechanical or fluid connection. A user-interface for a switch may be embodied as a button, lever, dial, touch-screen interface, electronic switch, or the like. The switch may be actuated manually by a user of the surface cleaning device or automatically by a controller, computer, or other electronic interface to enact a change in device operation.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

Figure 1:
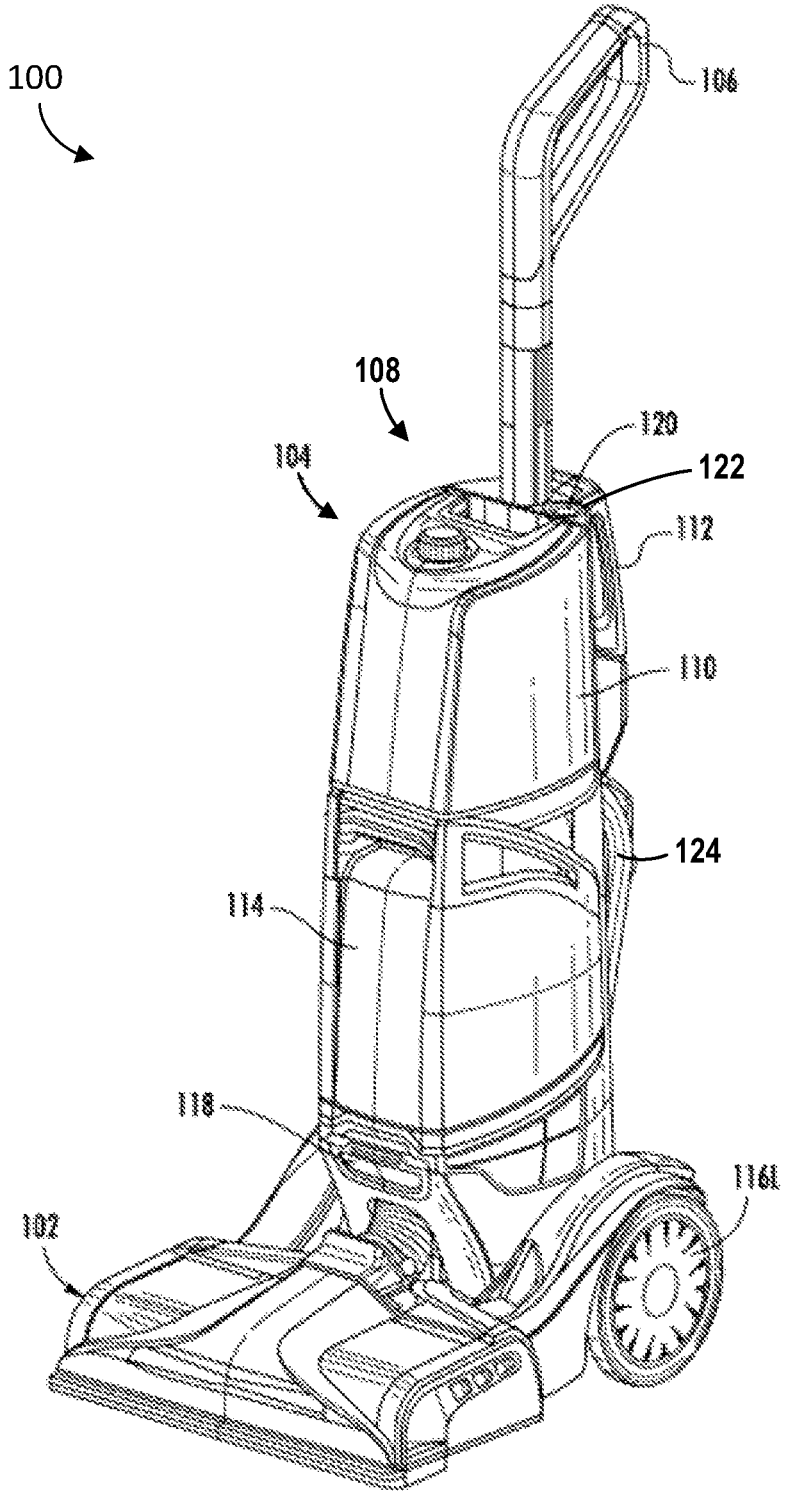
FIG. 1 illustrates a perspective view of a surface cleaning device, in accordance with one embodiment.
Figure 2:
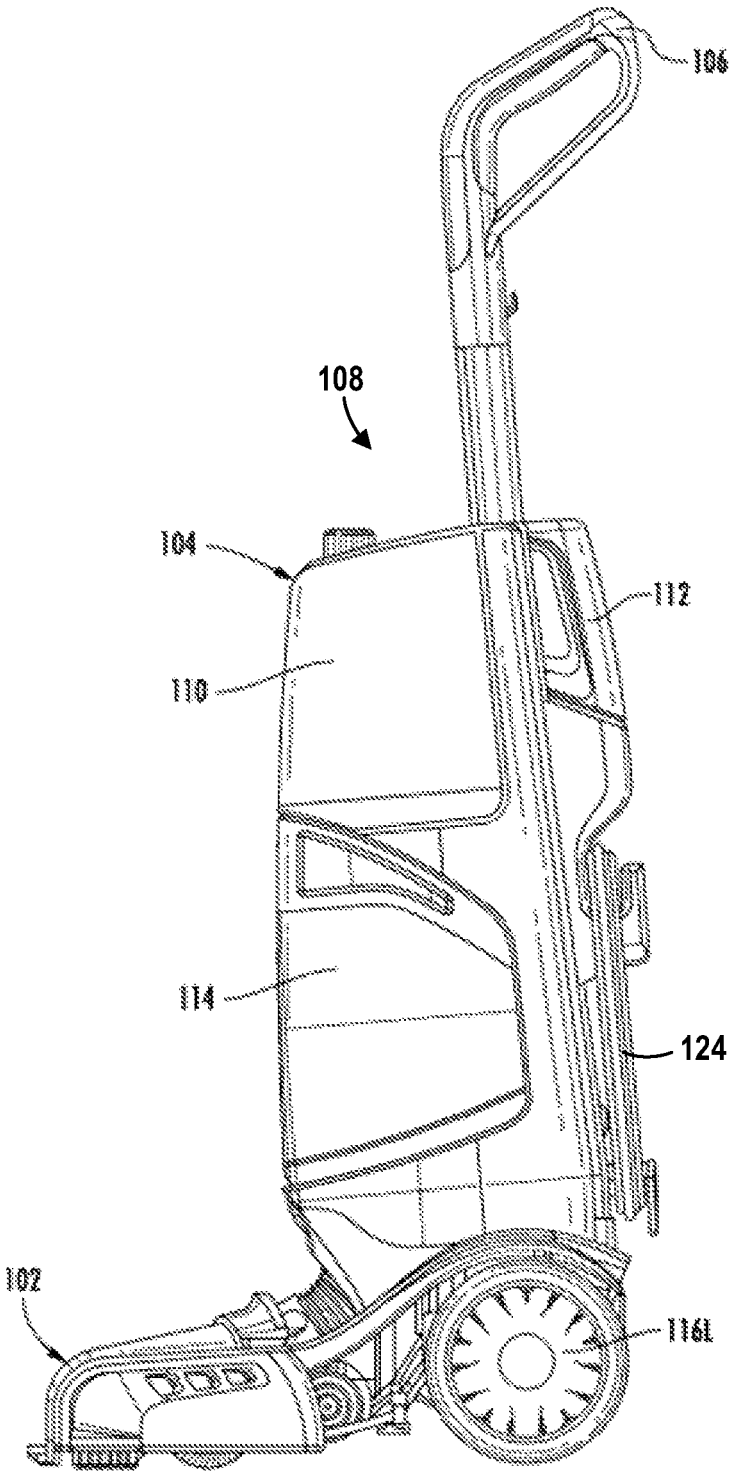
FIG. 2 illustrates a side view of the surface cleaning device, in accordance with one embodiment.
Figure 3:
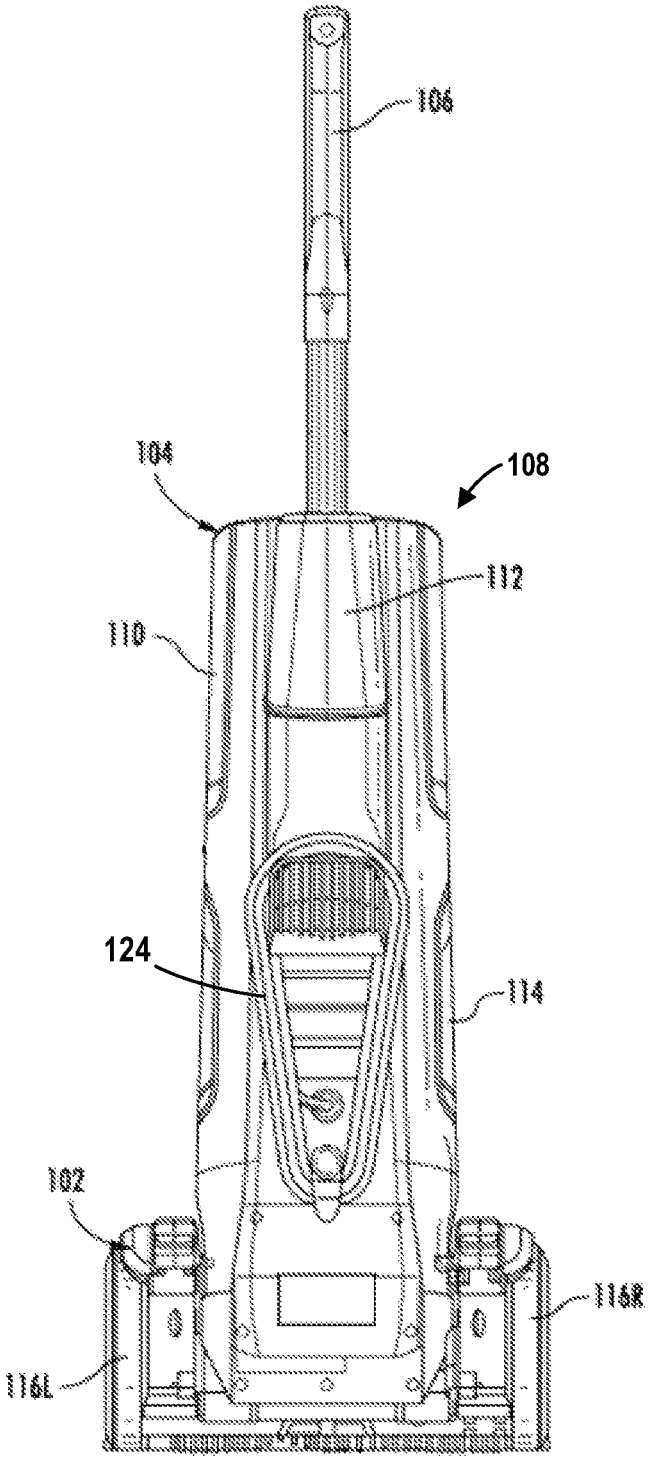
FIG. 3 illustrates a rear view of the surface cleaning device, in accordance with one embodiment.

FIGS. 1-3 illustrate a collection of views of a surface cleaning device, in accordance with one embodiment of the invention. Surface cleaners may be configured for use across a range of surface types (e.g., carpet and hard floors). As one example, a cleaner may be provided with a number of predetermined suction settings, liquid distribution rates, and/or brushroll or nozzle heights that may be manually adjusted by a user depending on the surface being cleaned. For example, a user may choose to raise a brushroll or nozzle height when transitioning with a surface cleaner from a hardwood floor to a high-pile carpet upon experiencing an increased resistance to movement of the surface cleaner along the surface as a result of increased suction and/or brushroll contact with the carpet when compared to the hardwood floor. However, the user may not know which settings are effective for cleaning the surface while still allowing for ease of movement of the surface cleaner. Further, the user may be burdened by being required to remember settings for various surfaces and needing to repeatedly adjust the surface cleaner settings when transitioning between, sometimes multiple, surface types. To overcome these challenges, the surface cleaner described herein automatically controls one or more operating components of the surface cleaner 100.

As used herein, the term "operating component" may be used to refer to elements of a surface cleaner that are configured to be controlled for adjusting cleaning operation. An operating component may include a suction motor operable to generate an airflow, a brushroll motor operable to drive a brushroll, an actuator operable to adjust a height of a brushroll from the surface, a pump operable to deliver a cleaning fluid, an actuator operable to control an airflow or fluid valve, and/or an indicator operable to indicate a parameter of the surface cleaner.

In an exemplary embodiment, the surface cleaning device, as depicted in FIGS. 1-6, is an upright carpet extractor, specifically a triggerless extractor. Prior upright carpet extractors are generally known in the art such as in commonly owned U.S. Pat. No. 6,681,442, and commonly owned U.S. Pat. No. 7,237,299. These prior extractors require a user to continually actuate a trigger while propelling the extractor to enable distribution of a cleaning solution to a surface to be cleaned. In contrast, the triggerless extractor 100 of the present invention does not rely upon continual actuation of a trigger in the handle or other user interface while propelling the extractor for control or initiation of cleaning solution distribution. In the present triggerless extractor, initiation of the distribution of the solution to the surface is not dependent on continual user actuation of an interface connected to the liquid distribution system. Stated another way, distribution of cleaning solution while propelling the extractor is independent of user interaction other than a user-initiated motion (e.g., a forward propelling motion). Instead, the present invention relies on the unique configuration of a controller controlling solution distribution initiation, and/or other operating components in response to movement of the extractor. As described herein with respect to the exemplary embodiment, the controller is configured to operate in a solution distributing mode during movement of the extractor 100 and in a non-distributing mode during movement of the extractor 100, wherein when in the distributing mode, the controller controls the extractor 100 to distribute cleaning solution to the surface, and when in the non-distributing mode, the controller controls the extractor 100 to not distribute the solution to the surface.

While an upright carpet extractor is depicted throughout the figures as an exemplary embodiment, it should be understood that various embodiments may be other types of surface cleaners such as upright vacuum cleaners, canister vacuum cleaners, stick vacuum cleaners, portable carpet extractors, handheld vacuum cleaners, and the like.

As seen in FIG. 1, which illustrates a perspective view of a surface cleaning device, in accordance with one embodiment, the extractor 100 has a base 102 and an upright portion 104, wherein the upright portion 104 is operatively coupled to a portion of the base 102. In the illustrated embodiment, the base 102 further includes a brush assembly 402 (as detailed in FIGS. 4 and 5) for scrubbing and agitating the surface to be cleaned. The upright portion 104 is typically pivotally coupled to the base 102 allowing for pivoting movement of the upright portion 104 about the base 102 in forwards and rearwards directions. The upright portion 104 has a handle 106 for propelling the base 102 over the surface with a pair of wheels 116R and 116L as depicted in FIG. 3, which illustrates a rear view of the surface cleaning device 100, in accordance with one embodiment. The handle 106 has a grip for engaging with a hand of the user. The illustrated cleaner 100 includes a power source 124 or conduit configured for supplying power to the surface cleaner 100. While in the illustrated embodiment, the power source 124 is a power cord configured to be operatively connected to an electrical outlet, it should be understood that in other embodiments, the cleaner 100 may include one or more rechargeable battery cells as a power source 124.

As seen in FIG. 2, which illustrates a side view of the surface cleaning device 100, in accordance with one embodiment, a supply tank assembly 108 is operatively coupled to the upright portion 104 of the extractor 100. In the illustrated embodiment, the supply tank assembly 108 includes a clean water supply tank 110 and a detergent supply tank 112. In some embodiments, the detergent supply tank 112 may be at least partially nested within an open portion formed by the clean water supply tank 110. The clean water supply tank 110 and the detergent supply tank 112 may be positioned on the upright portion 104 adjacent one another or separated from one another, and may be side-by-side or in an above-and-below configuration. In other embodiments, at least a portion of the supply tank assembly 108 may be optionally mounted and/or operatively coupled to the base 102. In one embodiment, the supply tank assembly 108 includes only one tank that the user may fill with solution for washing or clean water for rinsing as desired.

Clean water and/or detergent flow through tubing from the clean water supply tank 110 and the detergent supply tank 112, when present, to form a cleaning solution. In various alternatives, the flow of liquid from the water supply tank 110 and the detergent supply tank 112 may be selectively distributed individually by a valve or series of valves, or may be combined in a mixing valve, a mixing chamber, a selection switch, or other flow control as desired. In the illustrated embodiment, tubing from the water supply tank 110 and the detergent supply tank 112 deliver clean water and detergent, respectively, through a mixing chamber to a valve assembly 506, shown in FIG. 5 and to a pump 414 shown in FIG. 4. In the illustrated embodiment, the valve assembly 506 is enclosed in the housing of the base 102 as depicted in FIG. 5. In other embodiments, the valve assembly 506 may be positioned within or outside of a different portion of the extractor 100.

Figure 9A:
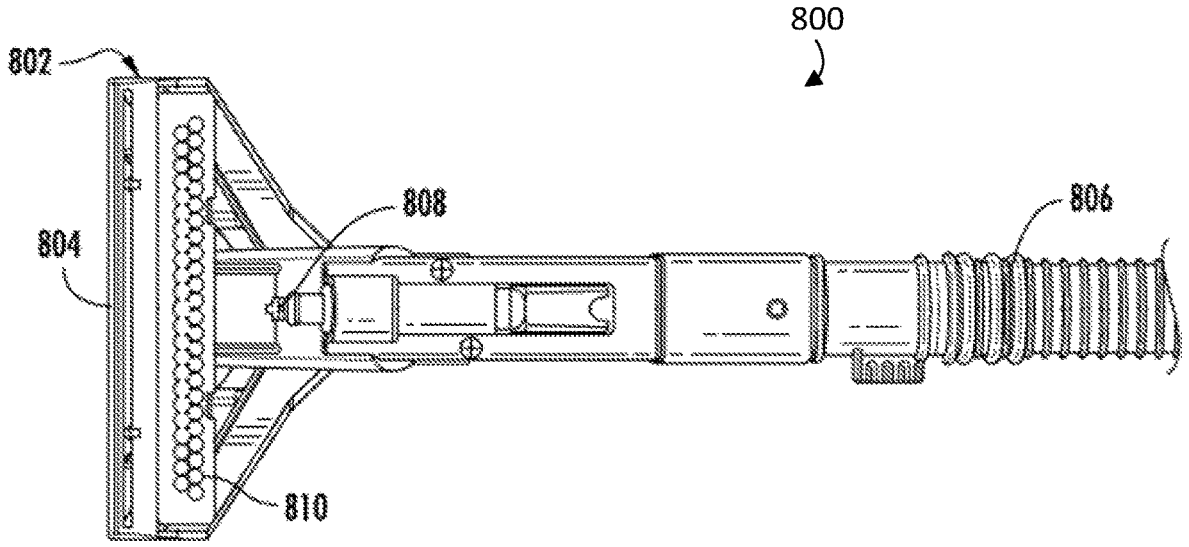
FIG. 9A illustrates a view of a cleaning tool of the surface cleaning device, in accordance with one embodiment.

The liquid is delivered through the tubing routed within the extractor 100 using gravity or routed with the assistance of a pump 414. In some embodiments, cleaning solution is drawn through the tubing and supplied to a cleaning tool 800 using the pump 414. In some embodiments, the cleaning solution is supplied to a distributer 410 in the base 102 using gravity. In the illustrated embodiment, the cleaning solution of clean water or a mixed cleaning solution (i.e., clean water and detergent when detergent is present) is selectively routed by either the valve assembly 506 to a distributer 410 (as depicted and discussed with respect to FIGS. 4 and 5) or by the pump 414 to a cleaning tool 800 (as depicted and discussed with respect to FIGS. 9A and 9B) via a system of supply tubes. The extractor 100 further includes a recovery tank 114, the details and function of which will be discussed with respect to FIGS. 4 and 5 below.

Figure 4:
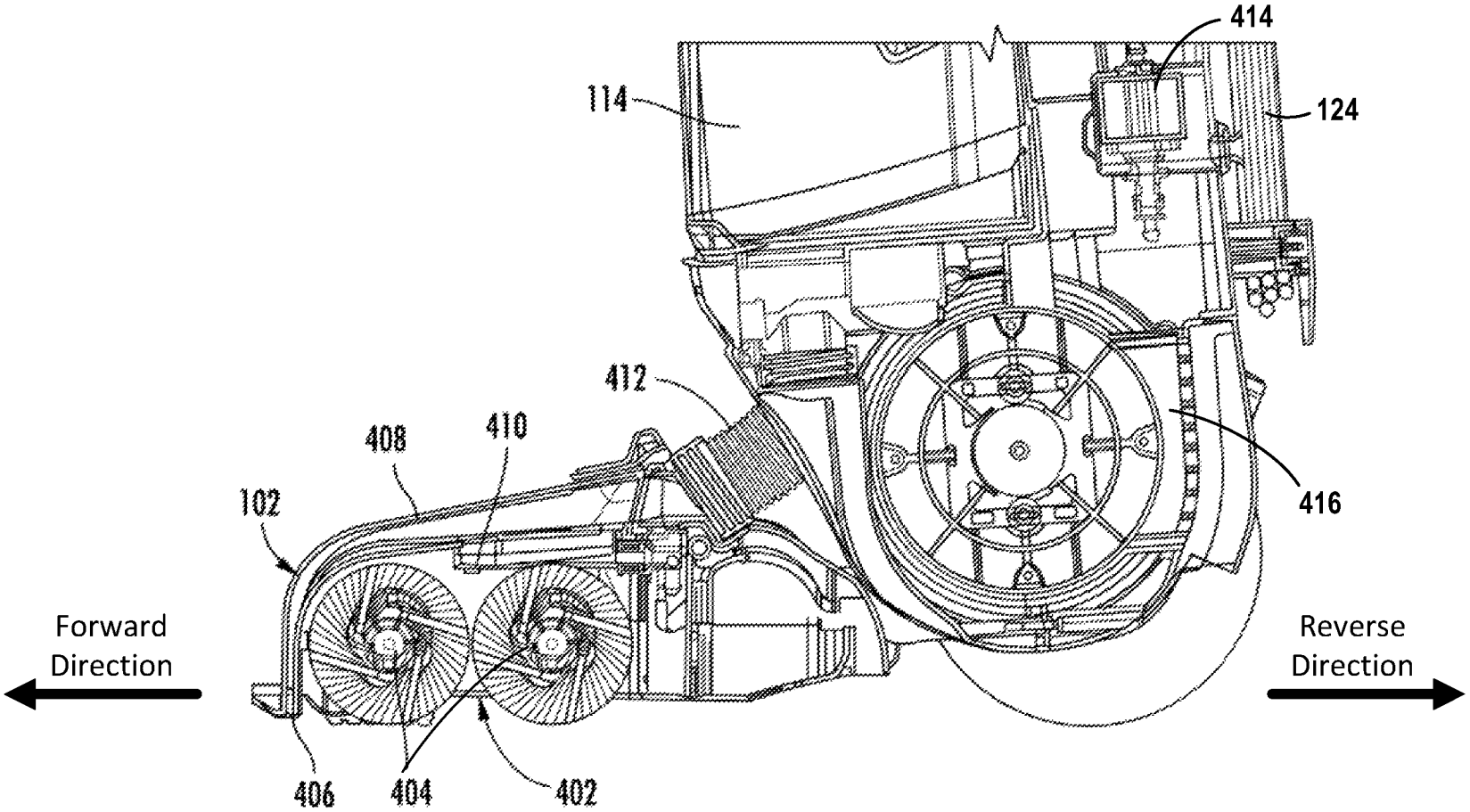
FIG. 4 illustrates a cross-sectional view of a base of the surface cleaning device, in accordance with one embodiment.
Figure 5:
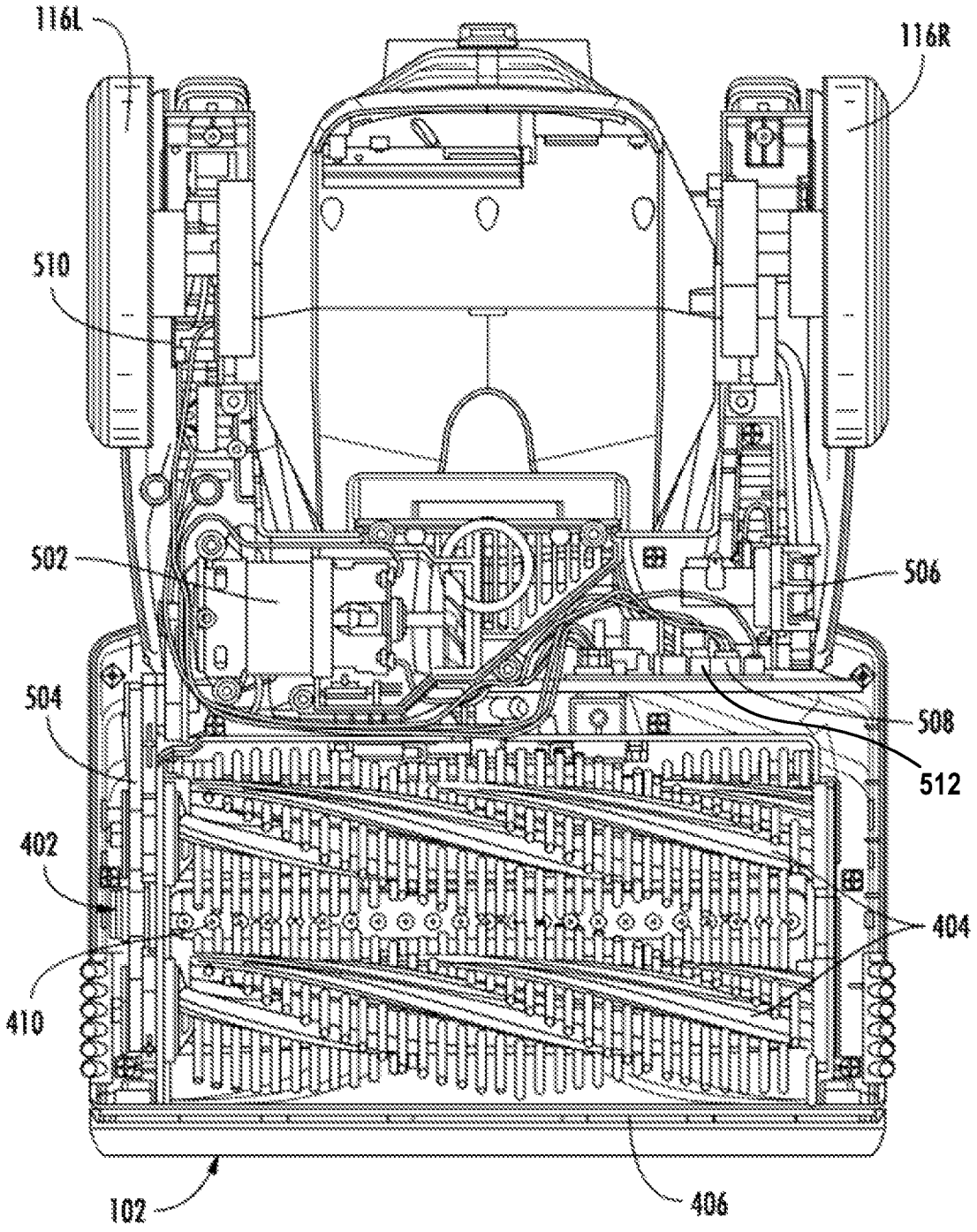
FIG. 5 illustrates a bottom view of the base of the surface cleaning device having a bottom cover removed, in accordance with one embodiment.
Figure 6:
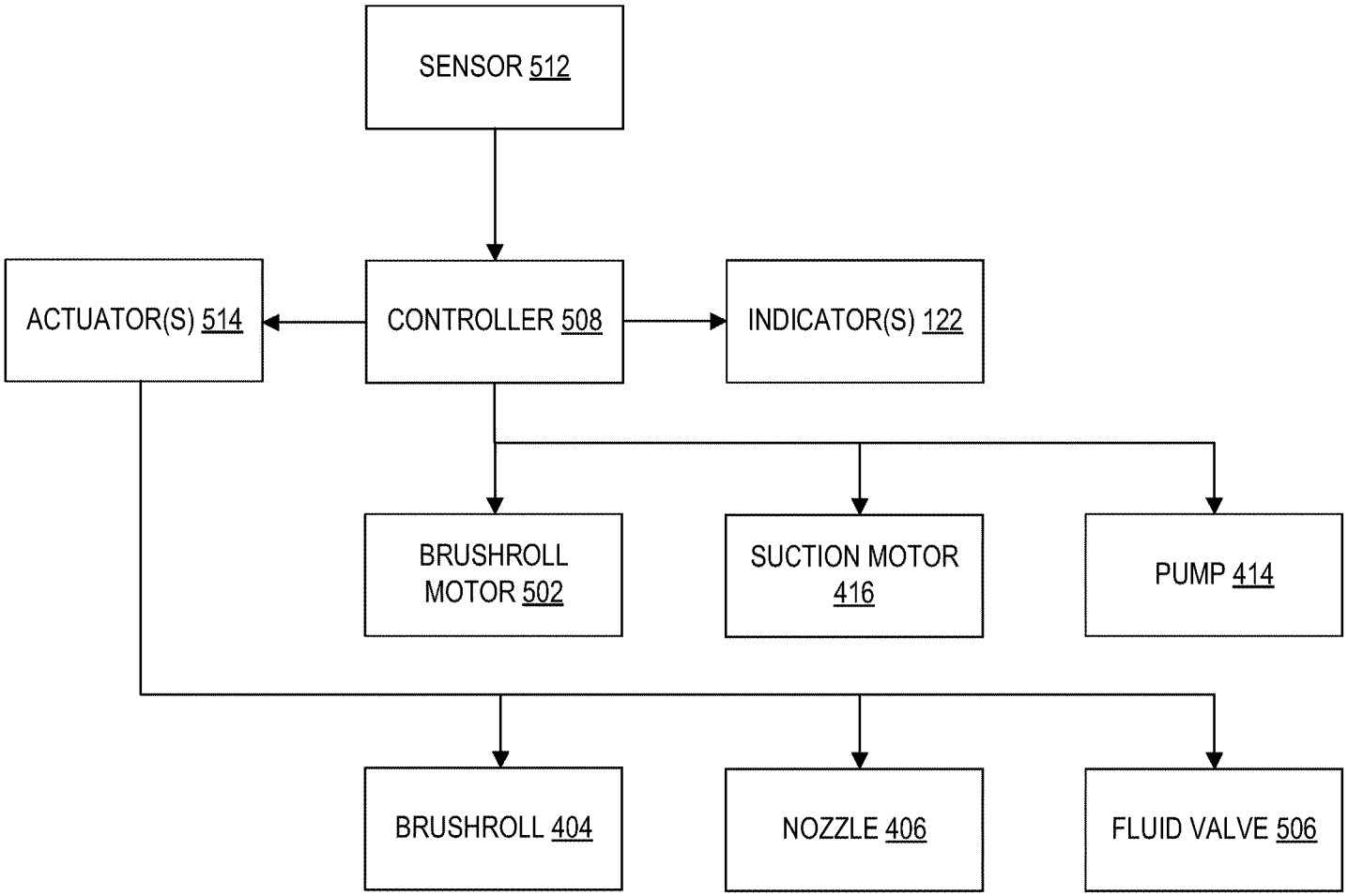
FIG. 6 provides a high level schematic diagram of a surface cleaner, in accordance with one embodiment.

FIG. 4 illustrates a cross-sectional view of the base 102 of the surface cleaning device 100, in accordance with one embodiment of the invention. FIG. 4 further illustrates forward and reverse movement directions of the base 102 along the surface. As illustrated in FIG. 4, the base 102 includes a brush assembly 402 further comprising one or more brushes 404 operatively coupled to the base 102. The one or more brushes 404 are engaged with the surface to agitate dirt and debris to be extracted along with the recovered cleaning solution. While two brushes 404 are illustrated in FIG. 4 for illustration purposes, there may be no brushes, one brush or multiple brushes operatively coupled to the brush assembly 402. Alternatively, a cloth, microfiber cloth or roll, squeegee, or other attachment can be employed instead of or in addition to the brush 404.

The base 102 further includes a fluid distributer 410. The distributer 410 distributes the cleaning solution to the surface to be cleaned. The distributor 410 may at least partially distribute the cleaning solution to the one or more brushes 404 of the brush assembly 402. The one or more brushes 404 agitate and scrub the cleaning solution on the surface to dislodge embedded dirt or debris. During operation, the extractor 100 distributes cleaning solution to the surface from the liquid distribution system including the supply tank 112 and distributor 410, while substantially simultaneously extracting and recovering the applied cleaning solution in a continuous operation.

The applied cleaning solution is extracted from the surface by a suction nozzle 406. In the illustrated embodiment, the nozzle 406 has an inlet at least partially spanning the front portion of the base 102. The suction nozzle 406 is in fluid flow communication with the recovery tank 114 by way of an air duct 408 formed by the base 102. The air duct 408 and the base 102 are operatively coupled to and in fluid communication with the upright portion 104 via an air passage 412 that leads to the recovery tank 114 of the extractor 100. A suction/vacuum source 416 such as a motor and fan assembly (not shown), housed in the upright portion 104 draws air through the nozzle 406 and the formed air passageway of the base 102, through the recovery tank 114 to then exhaust the air to the external atmosphere. In other embodiments, the suction source 416 may be alternatively housed in a different portion of the extractor 100, such as the base 102. In some embodiments, suction may be continuously generated by the suction source 416 during operation of the extractor 100.

The recovery tank 114 includes an air and liquid separator (not shown), such as one or more baffles or other separator as is understood by one skilled in the art, for separating the liquid (i.e., the recovered cleaning solution) from the air entering the recovery tank 114 and recovering the separated liquid in the recovery tank 114. The recovery tank 114 is removably coupled to the upright portion 104 to allow a user to remove the recovery tank 114 and empty the liquid contents. In other embodiments, the recovery tank 114 may be operatively coupled to one or more other portions of the extractor 100, such as the base 102.

FIG. 5 illustrates a bottom view of the base 102 of the surface cleaning device 100 having a bottom cover of the base 102 removed to provide visibility of the internal components of the base 102, in accordance with one embodiment of the invention. FIG. 5 further depicts the base 102 and brush assembly 402 of the extractor 100. As illustrated, the one or more brushes 404 of the brush assembly 402 rotate under the influence of a brush motor 502 that drives the rotation of the one or more brushes 404 with a belt 504 or, alternatively or additionally, drive gears operatively coupled to the brush motor 502. In other embodiments, the extractor 100 may not have a separate brush motor 502, wherein the one or more brushes 404 may instead be driven by a motor of the extractor 100 itself, such as the motor fan assembly as described above. As further illustrated in FIG. 5, the distributer 410 extends at least a portion of the length of the brushes 404 and has a plurality of distribution nozzles for distributing the cleaning solution to the surface and/or the brushes 404 during operation. The base 102 includes the wheels 116L and 116R, which are used to support the extractor 100 and facilitate movement of the extractor 100 over the surface when propelled by the user engaging the handle 106.

The surface cleaner 100 further includes a sensor 512 operatively coupled to a portion of the surface cleaner 100. In the illustrated embodiment, the sensor 512 is positioned adjacent the brushroll motor 502 on the base assembly 102. The sensor 512 is electronically coupled to a printed circuit board (PCB) controller 508 housed within a portion of the surface cleaner 100 (e.g., in the base assembly 102), wherein the controller 508 further comprises a processor, a memory, and a set of computer-based instructions stored in the memory to be executed by the processor for operation and control of components of the surface cleaner 100. Alternatively, the controller 508 is an integrated circuit having designed circuit portions to perform the described functions of the controller 508 as described herein.

In various embodiments, the controller 508 may be operatively connected with the brushroll motor 502, suction motor 416, pump 414, power source 124, one or more indicators 122, and one or more actuators 514 as discussed herein. The one or more actuators 514 are configured to be controlled to actuate operating components of the surface cleaner 100 such as the brushroll 404, suction nozzle 406, and fluid valve such as a valve contained in valve assembly 506 or another airflow valve, damper valve, plate or the like used to control airflow through a pathway of the cleaner 100.

The sensor 512 is configured for generating a signal based on movement of the surface cleaner 100 along the surface on which the surface cleaner 100 is cleaning. The sensor 512 may be a current sensor, pressure sensor, accelerometer, an encoder, Hall Effect sensor, microphone, optical or infrared sensor, image capturing device (e.g., a camera), or the like. The sensor 512 may be a piezoelectric sensor. In some embodiments, the signal is an output from a single sensor or may include outputs from two or more sensors. Multiple sensors may each output individual signals which may be used either individually or in combination to characterize movement of the surface cleaner 100 over a surface being cleaned. In some embodiments, the signal is a time-dependent signal, wherein the controller 508 monitors a signal collected by a sensor 512 over a period of time to determine changes in an observed measurement (e.g., current, pressure, vibrational force).

The controller 508 is configured to adjust operational settings of one or more operating components based on the signal from the sensor 512 to control functions of the surface cleaner 100 based on the signal. The signal is received by the controller 508, which determines operational settings of the surface cleaner 100 based on the signal and subsequently controls operating components of the surface cleaner 100 (e.g., suction motor 416, brushroll motor 502) to operate the surface cleaner 100 according to the operational settings. For example, the speed of the suction motor 416 may be increased or decreased to vary suction, or the brushroll motor 502 and thereby the speed of the brushroll 404 may be increased or decreased or turned off to vary surface agitation. The controller 508 may control a pump 414 for dispensing fluid. The controller 508 may control an actuator 514. Various actuators 514 may be provided for activating a height adjustment mechanism for raising and lowering the nozzle 406, raising and lowering the brushroll 404, activating a bleed valve for increasing or decreasing nozzle pressure, or for activating other features of the cleaner.

In one embodiment, the sensor 512 is an accelerometer, wherein the accelerometer is positioned on the surface cleaner 100 and configured to determine motion and direction of movement of the surface cleaner 100 on the surface. The accelerometer may be further configured to detect and measure proper acceleration of the surface cleaner 100. A signal is generated by the accelerometer and transmitted to the controller 508. As the signal is a time-dependent signal, the controller 508 may be configured to determine acceleration, speed, and displacement of the surface cleaner 100 through integration of the signal. The controller 508 is configured to control an operating component of the surface cleaner 100 in response to receiving the signal. For example, in response to determining that the surface cleaner 100 has stopped moving over the surface, the accelerometer may be configured to transmit a signal to the controller 508. In an alternative example, the controller 508 monitors the accelerometer signal or an integral of the accelerometer signal to determine when the cleaner 100 has stopped, for example when speed is zero. The controller 508 may then stop the suction motor 416 or brushroll motor 502 or stop distribution of liquid from a pump 414 in response to determining that the surface cleaner 100 has stopped moving on the surface. Similarly, the controller 508 may start operation of the suction motor 416, brushroll motor 502, or pump 414 in response to determining that the surface cleaner 100 has started moving on the surface.

In some embodiments, the sensor 512 is an accelerometer, wherein the accelerometer is configured to generate a signal based on user-initiated movement of the base 102 along the surface to be cleaned, wherein the signal is indicative of movement in the forward direction and indicative of movement in the rearward direction. The controller 508 may be configured to generate the signal as may include a first signal based on movement of the surface cleaner 100 by the user along the surface in a forward direction and a second signal based on movement of the cleaner by the user along the surface in a rearward direction. For one example, the first signal may include values greater than a reference value and the second signal may include values less than a reference value. In one embodiment, the reference value is zero, the first signal is positive, and the second signal is negative. Based on the signal, the controller 508 is configured to determine direction of the user-initiated movement and operate one or more operating components of the surface cleaner 100.

In one embodiment, the controller 508 is operatively connected to the liquid distribution system and configured to control the liquid distribution system based on the signal generated by the accelerometer. The controller is configured to control a component such as a pump 414 operable to deliver a cleaning fluid and/or an actuator 514, such as in the valve assembly 506, operable to control a fluid valve in order to control delivery of the cleaning fluid from the liquid distribution system. The controller 508 is configured to operate the operating components of the liquid distribution system in a distributing mode and a non-distributing mode depending on the movement of the surface cleaner 100. In a specific embodiment, the controller 508 is configured to operate the liquid distribution system in a distributing mode during movement of the surface cleaner 100 in a forward direction and in a non-distributing mode during movement of the surface cleaner 100 in a rearward direction. Stated another way, the controller 508 initiates distribution when the signal is indicative of movement in the forward direction and decreases or even interrupts distribution of the solution when the signal is indicative of movement in the rearward direction. In some embodiments, the controller 508 initiates distribution of the solution after determining that the surface cleaner 100 has moved a predetermined distance on the surface within a predetermined amount of time (e.g., ½ second, 1 second, 2 seconds, or any other predetermined amount of time as desired).

During operation, the controller 508 may be configured to determine a speed of movement of the surface cleaner 100 and increase or decrease a rate of distribution of cleaning solution based on the speed of movement of the surface cleaner 100 along the surface. For example, the rate of distribution may be increased with increased movement speed and decreased with decreased movement speed to maintain a relatively constant or even distribution of solution to the surface. In one embodiment, continued distribution of the cleaning solution to the surface is dependent on the continued generation of the signal by the accelerometer (i.e., continuous forward movement of the extractor), wherein the controller 508 stops distribution of the solution when the controller 508 does not receive the signal for a predetermined amount of time. Alternatively, or additionally, the signal generated by the accelerometer may be further indicative of the surface cleaner 100 not moving (i.e., speed is zero). The controller 508 may be configured to stop distribution of the solution when the controller 508 determines that the surface cleaner 100 is not moving based on the signal. In this way, excessive distribution of solution a particular area of the surface while the surface cleaner 100 is stopped.

In yet another embodiment, the controller 508 is operatively connected to the suction motor 416 and/or an actuator 514 operable to control an airflow in the surface cleaner 100 using an airflow valve, damper valve or plate, or similar fluid valve. The controller 508 is configured to control the suction motor 416 and/or the actuator 514 based on the signal generated by the accelerometer indicating one or more of forward motion, rearward motion, and speed of motion. The controller 508 controls these operating components to increase or decrease the airflow through the suction nozzle 406 based on the signal generated by the accelerometer. In a particular example, the controller 508 decreases the airflow through the suction nozzle 406 when the signal indicates forward movement of the surface cleaner 100 (e.g., during solution distribution to the surface). Conversely, the controller 508 increases the airflow when the signal indicates rearward movement (e.g., during solution recovery). In some embodiments, a rate of airflow provided through the suction nozzle 406 is based on the signal, wherein the rate of airflow is increased or decreased according to a respective increase or decrease of a speed of movement of the surface cleaner 100 along the surface. In one embodiment, the controller 508 may determine whether the surface cleaner 100 is not moving based on the signal from the accelerometer. In response to determining that the surface cleaner 100 is not moving, the controller 508 decreases or interrupts the airflow through the suction nozzle 406.

The upright portion 104 is typically pivotally coupled to the base 102 allowing for pivoting movement of the upright portion 104 between an upright storage position and the use position. In one embodiment, the accelerometer may be positioned in the surface cleaner 100 (e.g., in the upright portion 104) to determine whether the handle 106 of the surface cleaner 100 is in the upright storage position or the non-upright, use position. In one example, the accelerometer is a multi-axis accelerometer and the controller 508 determines the handle 106 location based on the movement of the accelerometer along a path as the handle 106 travels between the use position and the storage position. Based on the accelerometer signal being indicative of the upright storage position of the handle, the controller 508 is configured to automatically interrupt the airflow through the suction nozzle 406. In another embodiment, the controller 508 is configured to decrease or interrupt a flow of power to the surface cleaner from the power source 124 based on the signal indicating that the handle 106 is in the upright storage position for a predetermined amount of time.

In yet another embodiment, the controller 508 is operatively connected to a brushroll motor 502 operable to drive the brushroll 404. The controller 508 is configured to control the brushroll motor 502 and/or the actuator 514 based on the signal generated by the accelerometer. For example, the controller 508 is configured to increase the speed of the brushroll 404 via the brushroll motor 502 when the signal indicates forward movement of the surface and decrease the speed of the brushroll 404 when the signal indicates rearward movement. In some embodiments, the controller 508 is configured to increase or decrease the speed of the brushroll 404 according to a respective increase or decrease of as speed of movement of the surface cleaner 100 as determined by the generated signal. In another embodiment, the controller 508 is configured to interrupt rotation of or decrease speed of the brushroll motor 502 and by extension the brushroll 404. In one example, the controller 508 may interrupt the brushroll motor 502 from rotating the brushroll 404 when the controller 508 determines that the surface cleaner 100 is not moving along the surface for a predetermined amount of time (i.e., to prevent excessive surface friction and wear). The controller 508 may further control the brushroll motor 502 to change a direction of rotation of the brushroll 404 based on the signal or, in particular, a change in the signal (e.g., a signal indicating a change from forward to rearward movement along the surface).

In another embodiment, the controller 508 is further operatively connected to an actuator 514 operable to adjust the height of the brushroll 404 from the surface to be cleaned. The controller 508 is configured to change or adjust a height of the brushroll 404 from the surface based on the signal generated by the accelerometer. For example, the controller 508 may increase a height of the brushroll 404 from the surface based on the signal indicating that the surface cleaner 100 is not moving along the surface for a predetermined amount of time and, optionally, decrease the height upon the movement of the surface cleaner 100 resuming.

In one embodiment, the accelerometer is positioned in the upright portion 104 to determine whether the handle 106 of the surface cleaner 100 is in the upright storage position, and wherein the controller 508 is configured to interrupt the brushroll motor 502 from rotating the brushroll 404 when the handle 106 is in the upright storage position. In one embodiment, the controller 508 is configured to decrease the speed of the brushroll motor 502 when the handle 106 is in the upright storage position. In another embodiment, the controller 508 is operatively connected to an actuator 514 operable to adjust the height of the brushroll 404 from the surface to be cleaned and the controller 508 is configured to change or adjust a height of the brushroll 404 (e.g., to raise the brushroll 404 from the surface) when the handle 106 is in the upright storage position.

In some embodiments, the operational settings of the one or more operating components may be a mode of operation specific to operating the surface cleaner 100 on a particular surface to be cleaned (e.g., low-pile carpet mode, high-pile carpet mode, tile mode, hardwood mode) or a mode of operation associated with a particular function (e.g., dry mode, rinse mode, high suction mode). The operational settings may be user-activated via a user interface such as switch 120 (as depicted in FIG. 1), button, or other form of user interface configured to be manually actuated by the user. In one embodiment, the controller 508 is further configured to control the one or more operating components associated with one or more operational settings or modes based on the signal generated by an accelerometer during operation.

In an exemplary embodiment, the surface cleaner 100 is configured to operate in a "dry mode," wherein the controller 508 selectively discontinues or prevents the flow of cleaning solution to the distributor 410 and surface when the accelerometer signal indicates forward movement. In this way, the extractor 100 can be propelled forward in an operating state while applying suction without the normal distribution of cleaning solution. In some embodiments, activation of the switch 120 causes the controller 508 to control an actuator 514 and close a valve of the valve assembly 506 to discontinue distribution of solution. In other embodiments, the switch 120 interrupts the generation of the signal by breaking an electrical and/or mechanical connection associated with the controller 508 and/or accelerometer or other sensor 512. A user may desire to operate the extractor 100 in the above-described "dry mode" in order to apply suction or agitation to a particular portion of the surface without the distribution of additional cleaning solution.

Other examples of operational settings or modes include a "rinse mode," wherein the controller 508 controls one or more valves of valve assembly 506 to selectively discontinue the flow of cleaning solution and instead only deliver clean water to a surface when the accelerometer signal indicates forward movement. Additionally, the operational settings or modes may include a high suction recovery mode, wherein the controller 508 controls the airflow through the suction nozzle 406 to increase suction when the accelerometer signal indicates rearward movement of the surface cleaner along the surface.

In another embodiment, an accelerometer is configured to detect and measure vibrations within or of components of the surface cleaner 100 (e.g., base assembly 102, motor housing, suction motor 416, suction chamber or nozzle 406, etc.) during operation. The accelerometer monitors vibrations within at least a portion of the surface cleaner 100 and regularly transmits a signal to the controller 508 indicating a monitored vibrational force corresponding to surface type and/or condition. Alternatively, the controller 508 may be further configured to control operation of one or more of the components of the surface cleaner 100 to reduce the detected vibrations in conditions under which the accelerometer transmits a signal indicative of a vibrational force that is greater than desired for the surface cleaner 100, one or more of its components, or its operation. For one example, increased vibrational force produced by operation of the suction motor 416 may indicate decreased performance of the suction motor 416 on a particular surface, wherein the suction motor 416 is operating under an increased load (i.e., high-pile carpet). In response, the controller 508 controls operation of one or more of the components of the surface cleaner 100 to reduce the detected vibrations and relieve stress on the suction motor 416, for example by changing a supplied power to the suction motor 416 or by raising the nozzle 406 from the surface to reduce the detected vibrations. Similarly, an accelerometer may be used to measure vibrations produced by a brushroll motor 502.

In another embodiment, an accelerometer is positioned on a portion of the base assembly 102 adjacent the brushroll 404 and configured to detect and measure vibrations produced by the brushroll 404 in response to contacting a surface. For example, an increase in vibrational force generated by the brushroll 404 may indicate increasing resistive force experienced by the brushroll 404 on the surface (e.g., from high carpet piling, a rough surface, or debris). In response, the accelerometer generates a signal that is transmitted to the controller 508, which controls operation of the surface cleaner 100 based on the accelerometer signal. For example, the controller 508 may change the brushroll 404 height or change a supplied power to the brushroll motor 502 to reduce the detected vibrations. In one embodiment, the controller 508 may increase a supplied current to the brushroll motor 502 in order to overcome an excessive resistive force experienced by the brushroll 404 which may be caused by engagement of the brushroll 404 to the surface.

In yet another embodiment, an accelerometer is placed on or adjacent to an airflow or fluid separator and/or dirt cup, wherein the accelerometer is configured to detect and measure vibrations within the airflow separator and/or dirt cup caused by collected debris striking the sides of airflow separator and/or dirt cup. In response to a signal generated by the accelerometer, the controller 508 may change a mode of operation of the surface cleaner 100 suited for collecting the debris. For example, the controller 508 may increase suction from the suction motor 416 to better collect large-sized debris or an excessive amount of debris detected on a particularly dirty surface. In another example, the signal produced by the accelerometer in the airflow or fluid separator and/or dirt cup may indicate the presence of a large or foreign object collected by the surface cleaner 100 (e.g., a coin, a small toy, jewelry), wherein the controller 508 may cease operation of the suction motor 416 and provide an indication to the user of the presence of the large or foreign object.

In yet another embodiment, an accelerometer is positioned on the surface cleaner 100 and configured to detect and measure rotational fluctuations of the suction motor 416 through changes in a vibrational force produced by the suction motor 416. A detected change in the rotation of the suction motor 416 may indicate a blockage in the airflow pathway or a dirty filter, wherein the rotation of the suction motor 416 is altered due to an airflow being at least partially blocked or choked.

It should be understood that an accelerometer may be positioned in or adjacent to any portion of the airflow pathway or within or on any portion of the surface cleaner 100 body to detect vibration produced by any operating component of the surface cleaner 100.

In yet another embodiment, a sensor 512 is configured to sense and determine a current supplied to the brushroll motor 502 and generate a signal that is sent to the controller 508 corresponding to the current. An increased brushroll motor current may be a result of the brushroll 404 experiencing increased mechanical resistance from a contacted surface (e.g., high-pile carpet), wherein the brushroll motor 502 is supplied with an increased current in order to maintain the brushroll 404 at a constant rotational speed. By raising a height of the brushroll 404, an amount of resistance experienced by the brushroll 404 from contacting the surface may be reduced thereby also reducing the power required by the brushroll motor 502 to maintain the constant rotational speed.

In yet another embodiment, the sensor 512 is a pressure sensor configured to measure a pressure value within at least a portion of the airflow path of the surface cleaner 100 and generate a signal that is sent to the controller 508. In one example, the signal indicates pressure variation in the airflow pathway due to suction from the inlet opening being close to a surface to be cleaned. In response, the controller 508 controls the power supplied to the suction motor 416. Alternatively, the controller 508 may be further configured to control a height of the brushroll 404 and/or floor nozzle 406 according to the signal from the pressure sensor, whereby raising the height of the brushroll 404 and/or floor nozzle 406 relieves excessive suction experienced by the surface cleaner 100 on the surface and allow for easier movement of the surface cleaner 100 across the surface.

In another embodiment, the controller 508 is in communication with an indicator 122 of the surface cleaner 100. An indicator 122 may include one or more lights, displays, speakers, or the like for providing an indication or information associated with a parameter of surface cleaner 100. For example, the indicator 122 may display an identified surface type or condition of the surface on which the surface cleaner 100 is traveling. In another example, the indicator 122 may display a status of an operating component of the surface cleaner 100 to the user such as the liquid distribution system of the surface cleaner being in a distributing mode (e.g., distributing fluid with a pump) or a non-distributing mode. In yet another example, the indicator 122 may indicate a status of an airflow through the suction nozzle 406 such as a reduction in airflow due to a dirty filter or other airflow pathway blockage. In another example, the indicator 122 may be activated based on a speed and/or height of the brushroll 404. In another embodiment, the indicator 122 may be activated based on a position of the handle 106 (e.g., when positioned in an upright storage position). Furthermore, the indicator 122 may be activated based upon determining that the surface cleaner 100 is not moving for a predetermined amount of time.

Figure 7A:
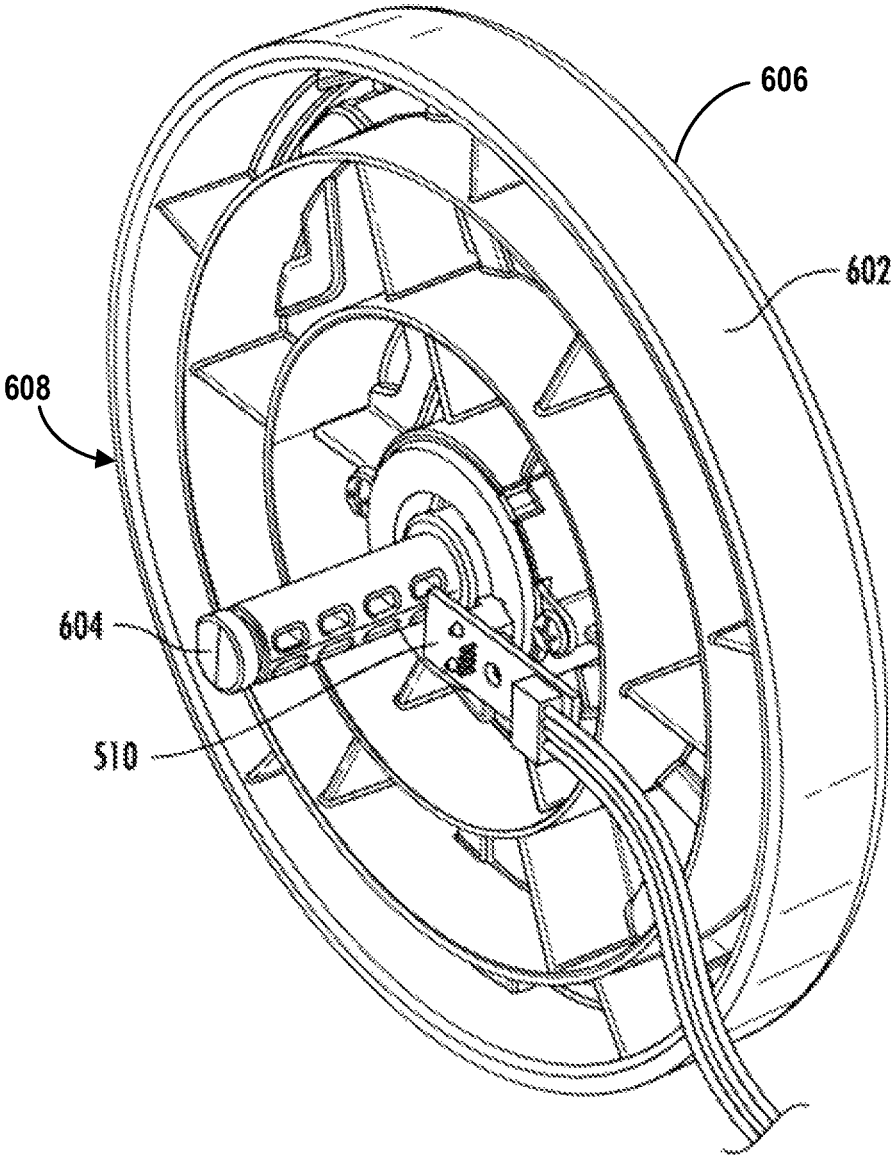
FIG. 7A illustrates a perspective view of a wheel and encoder of the surface cleaning device, in accordance with one embodiment.

In yet another embodiment, the sensor 512 is an encoder 510 positioned in a surface cleaner such as the extractor provided in the figures. In the illustrated embodiment, the encoder 510 is configured to sense motion of the extractor 100. FIG. 7A illustrates a perspective view of a wheel and encoder of the surface cleaning device, in accordance with one embodiment of the invention. In the illustrated embodiment, an encoder 510 is operatively coupled adjacent one of the wheels. The wheel 602 may be, for example, the wheels 116R or 116L of the previous figures or a separate wheel used for the purpose of detecting movement and direction of movement.

The encoder 510 is electronically coupled to a printed circuit board (PCB) controller 508 housed within the extractor 100 (e.g., in the base 102), wherein the controller 508 further comprises a processor, a memory, and a set of computer-based instructions stored in the memory to be executed by the processor for operation and control of components of the extractor 100. In one embodiment, the encoder 510 is configured to sense and determine rotation and direction of the wheel 116L and convert the determined rotation and direction into an electronic signal that is sent to the controller 508. The signal may be an output from a single sensor, or may include outputs from two or more sensors. Based on receiving the signal from the encoder 510, the controller 508 is configured to adjust operation of one or more components of the extractor 100. For one example, the controller controls distribution of the solution based on the signal from the encoder during operation of the triggerless extractor. Stated another way, the controller 508 is configured to operate in a distributing mode during movement of the base 102 and in a non-distributing mode during movement of the base 102 based on the signal generated by movement of the base (e.g., a forward and rearward propelling motion) during operation of the triggerless extractor 100. Alternatively, the controller could be an integrated circuit having designed circuit portions to perform the described functions of the controller as described herein.

As previously discussed, the illustrated encoder 510 detects a motion of the extractor 100 along the surface in order to automatically control operations of the extractor 100 (e.g., cleaning solution distribution). For example, in response to detecting forward movement of the extractor 100 (as shown in FIG. 4), the encoder 510 generates a signal, which is transmitted to the controller 508. As further discussed below, the signal in one embodiment includes outputs from two or more Hall Effect sensors. In alternative embodiments, the signal includes output from one Hall Effect sensor or an optical sensor or a switch or other sensor. As previously discussed, in other alternative embodiments, the sensor 512 may include a current sensor, pressure sensor, accelerometer, an encoder, Hall Effect sensor, microphone, optical or infrared sensor, image capturing device (e.g., a camera), or the like. Based on receiving the encoder signal generated during movement of the base, the controller 508 controls the valve assembly 506 to at least partially open the valve assembly and initiate a flow of cleaning solution to the distributer 410 in the distribution mode for delivery to the surface during movement of the base. In some embodiments, distribution and/or initiation of distribution of the cleaning solution is only dependent on generation of the encoder signal transmitted to and received by the controller 508 during movement of the base. Stated another way, the controller 508 is configured to change from the non-distributing mode to the distributing mode based on the encoder signal and independent of user interaction with the extractor 100 other than the user-initiated movement of the extractor (e.g., a forward and rearward propelling motion). In this embodiment, the controller 508 stops distribution of the solution when the controller 508 does not receive the signal. In one alternative, the controller 508 also changes the power to the suction motor based on the encoder signal, for one example to decrease the amount of suction during forward motion. In another alternative, the controller 508 also changes the control of the brush motor based on the encoder signal, for one example to decrease the rate of rotation, or the direction of rotation, during reverse motion.

Figure 8:
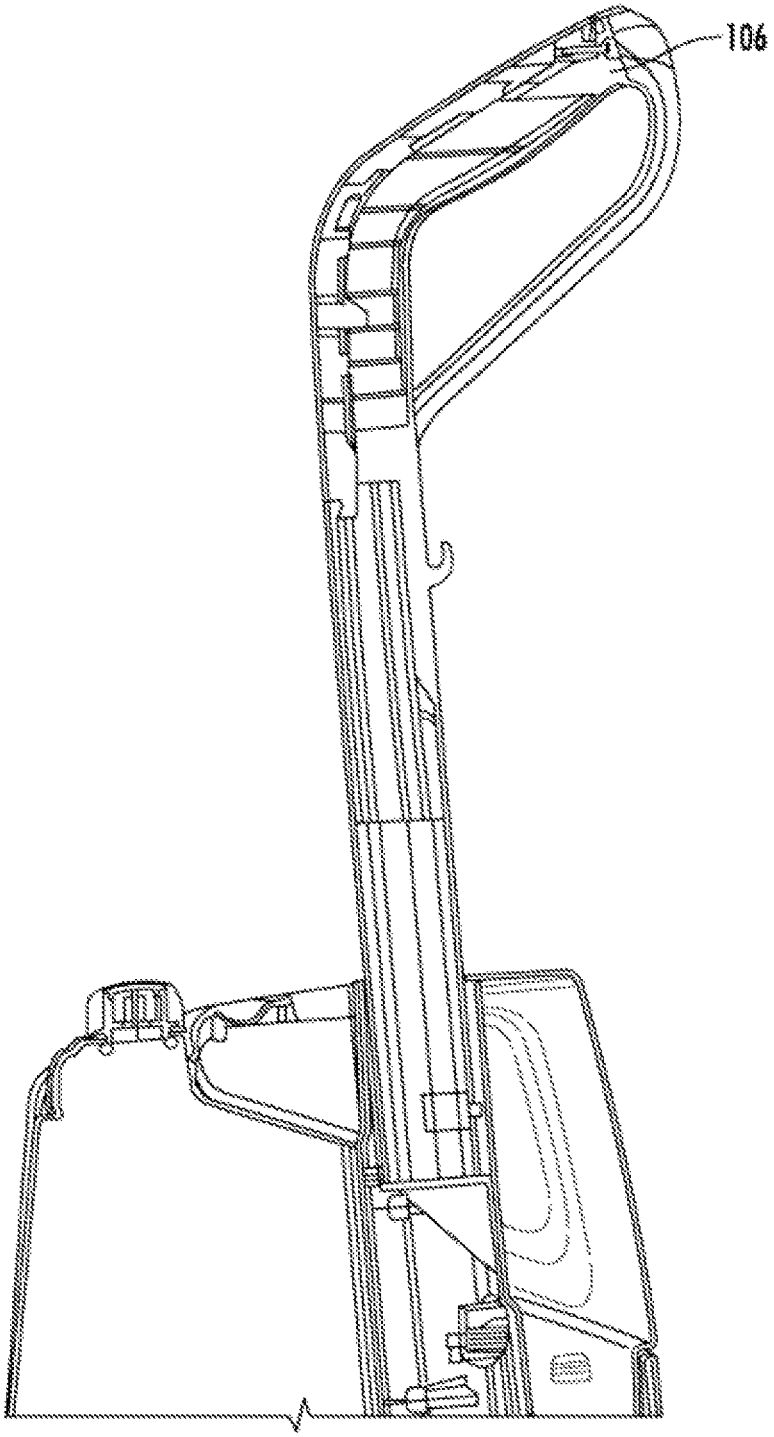
FIG. 8 illustrates a cross-sectional view of a handle of the surface cleaning device, in accordance with one embodiment.

Prior art extractors rely on continual user actuation of a trigger to enable distribution of a cleaning solution to a surface to be cleaned. However, as reinforced by FIG. 8 which illustrates a cross-sectional, internal view of the handle 106 of the surface cleaning device, in accordance with one embodiment of the invention, the extractor 100 of the present invention does not possess or rely upon actuation of a trigger or other user interaction in the handle 106 for control or initiation of cleaning solution distribution. Instead, the present invention relies on the unique configuration of the controller 508 in conjunction with the encoder 510 to control solution distribution initiation. As depicted in FIG. 8, the handle 106 does not include a trigger. In some embodiments, the handle 106 does not include any form of electrical or mechanical switch or other user interaction that requires user input in order to distribute the cleaning solution.

In one embodiment, continued distribution of the cleaning solution to the surface is dependent on the continued generation of the signal by the encoder 510 (i.e., continuous forward movement of the extractor). In the illustrated embodiment, continued distribution of the solution to the surface is based on continued generation of the signal during operation of the triggerless extractor, and the controller stops distribution of the solution when the controller does not receive the signal for a predetermined amount of time, for example ½ second, 1 second, 2 seconds, or any other predetermined amount of time as desired.

As previously discussed, an encoder 510 electronically coupled to the controller 508 is configured to sense motion of the extractor 100. In the illustrated embodiment, the encoder 510 is a rotary encoder operable to sense a rotation and direction of a wheel 602 of the extractor 100 during operation. The wheel 602 is operatively coupled to the extractor 100 via an axle 604 that allows for clockwise or counterclockwise rotation of the wheel about the axle 604 to allow the extractor 100 to be propelled in either a forward or reverse direction (as illustrated in FIG. 4). In some embodiments, each of the wheels 116R and 116L of the extractor 100 have an exterior face 606 and an interior face 608, wherein the interior face 608 is operatively coupled to the extractor 100 via the axle 604. As used herein, a forward rotation refers to a clockwise rotation of the exterior face 606 of the wheel 116R and a counterclockwise rotation of the exterior face 606 of the wheel 116L as viewed from a position looking at the exterior faces of the wheels. Conversely, as used herein, a reverse rotation refers to a counterclockwise rotation of the exterior face 606 of the wheel 116R and a clockwise rotation of the exterior face 606 of the wheel 116L as viewed from a position looking at the exterior faces of the wheels.

Figure 7B:
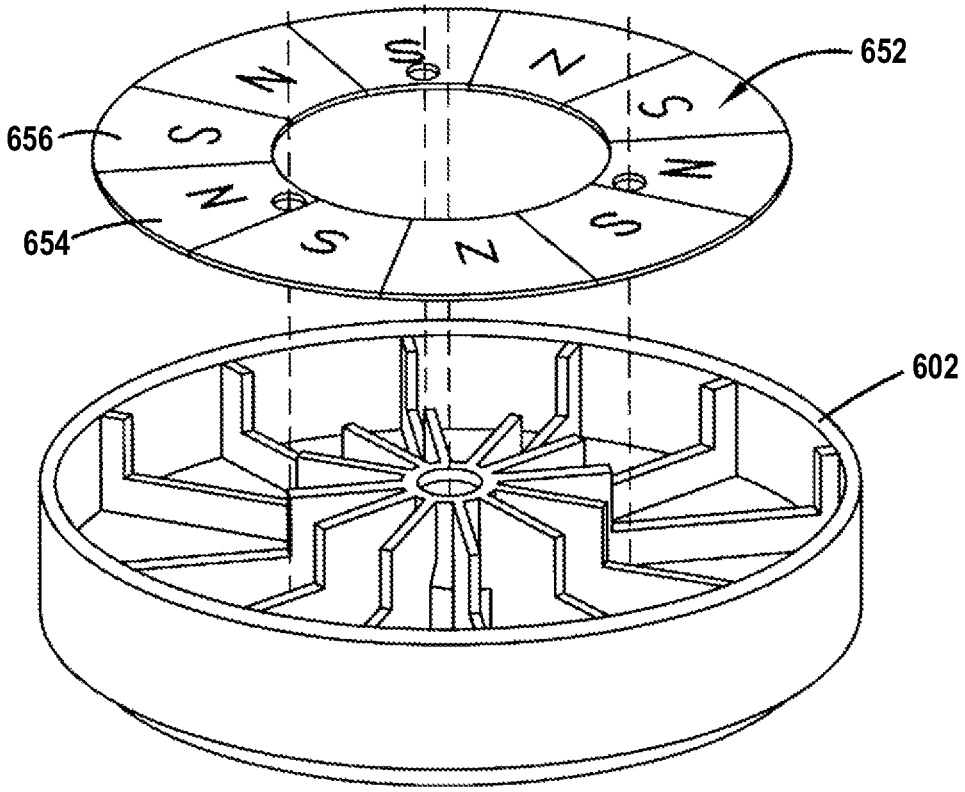
FIG. 7B illustrates a view of a magnetic element and wheel of the surface cleaning device, in accordance with one embodiment.

In one embodiment, such as the illustrated embodiment, the encoder 510 includes two Hall Effect sensors. As seen in FIG. 7B, which illustrates a magnetic element and wheel of the surface cleaning device according to one embodiment, the wheel 602 may include a magnetic element 652 operatively coupled to the wheel 602, wherein the magnetic element 652 further includes one or more negative nodes 654 and positive nodes 656. The magnetic element 652 has a circular or ring-like shape which conforms to the shape of the wheel 602 or at least partially encircles the axle 604. The encoder 510 and controller 508 detect the nodes of the magnetic element 652 as the negative nodes 654 and positive nodes 656 travel past the first and second Hall Effect sensors, each sensor producing an output signal. The Hall Effect sensors are positioned such that the controller 508 determines a rotational direction based on which sensor output it receives first. The controller optionally determines a rate of speed of the wheel 602 based on the frequency of magnetic nodes passing the sensors. The controller 508 uses the signals generated by the sensor detecting the movement of the nodes of the magnetic element 652 in order to determine if the extractor 100 is moving along the surface, wherein a larger number of nodes provides a more accurate determination of a movement state and rotational direction and speed of the wheel 602. In one embodiment, the magnetic element 652 may have twelves nodes. In other embodiments, the magnetic element 652 may have more than twelve nodes. In yet other embodiments, the magnetic element 652 may have less than twelve nodes. Other magnetic or optical encoder arrangements may be used.

To confirm an intentional movement of the wheel 602 along the surface, the controller 508 may analyze one or more signals received from the encoder 510, said one or more signals being produced as a result of negative nodes 654 and the positive nodes 656 moving past the encoder 510 during rotation of the wheel 602. In one embodiment, the controller 508 confirms that the extractor 100 is being intentionally moved forward along the surface only when the controller 508 determines that a predetermined distance of movement occurs within a predetermined amount of time (e.g., at least ten nodes must pass the encoder within two seconds, or other desired rate) indicating forward movement. In response to confirming the forward movement, the controller 508 controls the distributer 410 to distribute the cleaning solution to the surface. Alternatively, a movement of the magnetic element 652 may be determined to be below a predetermined threshold and therefore insufficient to trigger cleaning solution distribution by the controller 508. For example, an insufficient amount of detected movement of the magnetic element 652 may be indicative of merely an unintentional movement or accidental jostling of the extractor 100, wherein a distribution of cleaning solution is not desired.

As an alternative to the rotary Hall Effect encoder discussed in the previous illustrated embodiment, the encoder may be any encoder or sensor configured to sense motion of the extractor. In various alternatives, the encoder may sense the relative or absolute position of one or more wheels. In one alternative, the encoder 510 may be a linear encoder, wherein the linear encoder produces a signal based on detected motion along a linear path, such as the extractor 100 traveling along the surface. In another alternative, the encoder 510 is an optical or infrared sensor, wherein the optical sensor detects motion of the extractor 100 based on a collection by the sensor. For example, an optical sensor may detect the absolute or relative position of a wheel based on detecting movement of a visual pattern or apertures applied to a surface of the wheel or other surface associated with the wheel or movement of the extractor. In another example, the optical sensor detects movement along the surface to be cleaned by collecting an image of a surface that the extractor 100 is moving along. In another alternative embodiment, the encoder includes a mechanical member, wherein wheel movement causes movement of a spring or magnetic component of the extractor 100 to move a lever or other member to trigger a switch or Hall Effect sensor for generation of a signal. In yet another alternative, the encoder 510 is a switch that is physically actuated as a result of user-applied force applied to the handle causing movement of the extractor 100, the switch triggering generation of a signal to send to the controller 508.

In another embodiment, in addition to detecting movement and direction of movement, the encoder 510 also detects speed of movement of the extractor, for example by monitoring a rotational speed of the wheel 602, wherein the signal generated and transmitted by the encoder 510 to the controller 508 further includes information related to the speed of rotation of the wheel 602. In response to receiving the encoder signal, the controller 508 increases or decreases the rate of distribution of cleaning solution according to a respective increase or decrease of the speed of forward movement, e.g., speed of rotation of the wheel 602, during operation of the triggerless extractor. In one embodiment, the valve assembly 506 is configured to provide a variable flow rate (e.g., with a control valve) and to vary the size of a flow passage opening from the valve assembly 506 to the distributer thereby providing the variable flow rate. The variable flow rate may be provided in predetermined increments in response to predetermined incremental changes in speed, or may be variable over a substantially continuous range of flow rates correlated to vary with a predetermined range of speeds to allow for highly tailored, operation-dependent solution flow rates. In this way, the controller 508 may control the valve assembly 506 to provide a desired rate of distribution of the solution to the surface based on speed (e.g., a desired amount of cleaning solution applied per linear foot of the traversed surface). In one embodiment, the controller 508 calculates and delivers a cleaning solution distribution flow rate or amount based on speed, wherein a calculation may be based on the signal and/or, optionally, one or more predetermined equations, relationships, look-up tables, or the like stored in the memory of the controller 508. Providing a variable cleaning solution distribution reduces application of either an excess of or a deficiency of cleaning solution to the surface. Additionally, by incorporating the triggerless design as described herein, user error may be essentially eliminated or drastically reduced through automation of the cleaning solution distribution.

In yet another embodiment, a second signal may be generated by the encoder 510 in response to detecting a reverse motion of the extractor 100 or a reverse rotation of the wheel 602. In this embodiment, the controller stops distribution of the solution when the controller does not receive the encoder signal generated by movement of the base for a predetermined amount of time or upon receiving the second signal indicating the reverse extractor 100 movement or reverse rotation of the wheel 602. In response, the controller 508 closes the valve assembly 506 to interrupt or discontinue the distribution of the cleaning solution to the surface in a non-distributing mode during movement of the base 102 while maintaining suction. Stated another way, the controller 508 is configured to change from the distributing mode to the non-distributing mode based on the encoder signal and independent of user interaction with the extractor 100 other than the user-initiated movement of the extractor (e.g., a forward and rearward propelling motion). In one alternative, the controller changes the power supplied to the suction motor when receiving the second signal, for example to increase the amount of suction during the reverse movement stroke. In some embodiments, user actuation of a switch may generate a third signal which, upon being received by the controller 508, overrides the first signal or the second signal to interrupt the distribution of the cleaning solution.

In another embodiment of the invention, the extractor 100 may alternatively or additionally have a second valve assembly (not shown) in fluid communication with the valve assembly 506 and the distributer 402 with tubing. The second valve assembly includes a control valve configured for varying the size of a flow passage from the first valve assembly 506 to the distributer 402 and providing the variable flow rate. The controller 508 is configured to operate the second valve assembly in addition to the first valve assembly 506. In this way, an amount and/or rate of cleaning solution delivered to the distributor 402 for application to the surface can be varied and controlled. In this instance where the first valve assembly 506 metes out only clean water, the controller could control the second valve assembly to vary the output of clean water by a desired dispense amount or flow.

In another embodiment, the extractor 100 further includes a switch 120 (as depicted in FIG. 1), button, or other form of user interface configured to be manually actuated by the user to selectively discontinue or prevent the flow of cleaning solution to the distributor 410 and surface. In this way, the extractor 100 can be propelled forward in an operating state while applying suction without the normal distribution of cleaning solution (i.e., a dry mode). In some embodiments, activation of the switch 120 causes the controller to close the valve assembly 506 to discontinue distribution of solution. In other embodiments, the switch 120 interrupts the generation of the encoder signal by breaking an electrical and/or mechanical connection associated with the controller 508 and/or encoder 510. In a particular example, a user may desire to operate the extractor 100 in the above-described "dry mode" in order to apply suction or agitation to a particular portion of the surface without the distribution of additional cleaning solution.

The switch 120 may be included in a user interface of the extractor 100, wherein the user interface may include one or more switches, buttons, touch screen interfaces, dials, displays, gauges, indicators, lights, or the like for controlling or monitoring one or more functions and operation states of the extractor 100 other than causing distribution of cleaning solution during motion of the extractor (e.g., toggling suction on/off, controlling brush movement, recovery tank fill level, or the like). For example, the user interface may comprise a switch for toggling between high and low suction settings of the extractor 100.

Figure 9B:
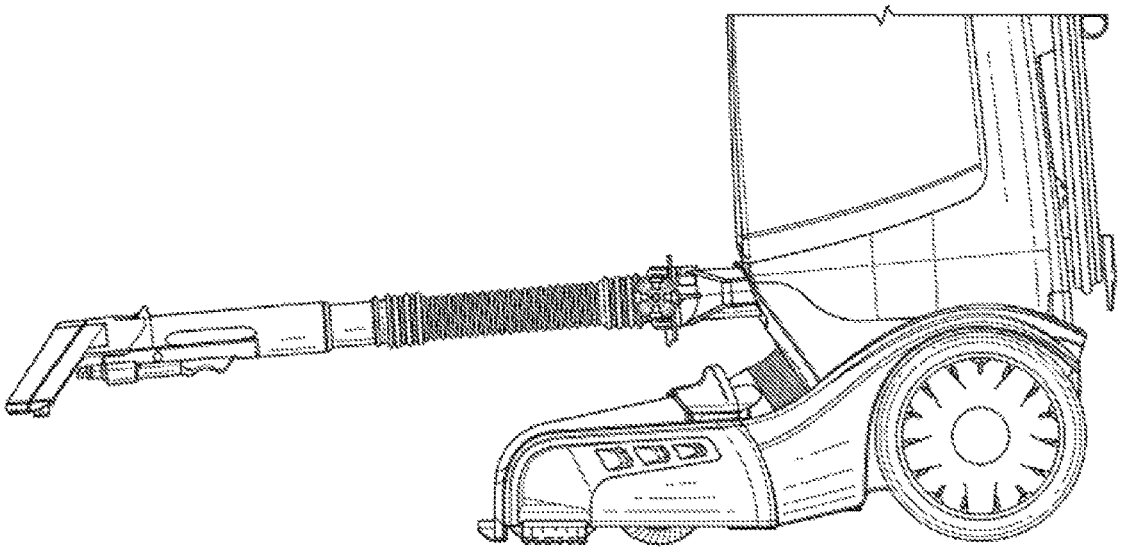
FIG. 9B illustrates a side view of the cleaning tool mounted to the surface cleaning device, in accordance with one embodiment.

FIG. 8A illustrates a view of a cleaning tool of the surface cleaning device, in accordance with one embodiment of the invention. The cleaning tool 800 is configured to be operatively coupled to a sealable connection port 118 (as seen in FIG. 1) of the extractor 100. The connection port 118 includes a fluid distribution line and a suction duct. The cleaning tool 800 has a cleaning head 802 further having a suction inlet 804 in fluid communication with tube 806 which can be operatively coupled to the suction duct of the connection port 118 of the extractor 100 as depicted in FIG. 9B. A distribution nozzle 808 attached to the fluid distribution line of the connection port is in fluid communication with the pump 414 to allow for the distribution of cleaning solution from the pump 414, through the fluid distribution line of the connection port, and to the cleaning tool 800. The cleaning tool 800 may further include a brush 810 for agitating and scrubbing a surface to assist in removing dirt or debris on the surface to be cleaned. Connecting the cleaning tool 800 to the connection port 118 of the extractor 100 reroutes the suction flow path to be in communication with the suction duct of the connection port allowing the cleaning tool 800 to be used for cleaning a surface instead of the base 102. In another embodiment, the cleaning tool 800 includes a motorized brush or brushroll.

FIG. 9 provides a high level process flow for user operation of the surface cleaning device, in accordance with one embodiment of the invention. In block 902, the user powers-on the surface cleaning device (i.e., the extractor 100) and initially propels the extractor 100 in a forward direction over a portion of a surface to be cleaned, the forward motion initiating distribution of the cleaning solution during operation of the extractor 100. The rotation of the wheel 602 of the extractor 100 in the forward direction is detected by the encoder 510 which transmits an encoder signal to the controller 508. In response to the signal, the controller 508 controls the valve assembly 506 to at least partially open and distribute a cleaning solution to the surface. The user continues to propel the extractor 100 in a substantially forward direction over a portion of the surface for continued distribution of cleaning fluid and optionally surface agitation by one or more brushes 404 of the brush assembly 402. Suction is applied by a suction source of the extractor 100 to recover liquid and dirt from the surface. In one alternative, the controller is configured to reduce or omit suction during forward movement of the extractor.

Figure 10:
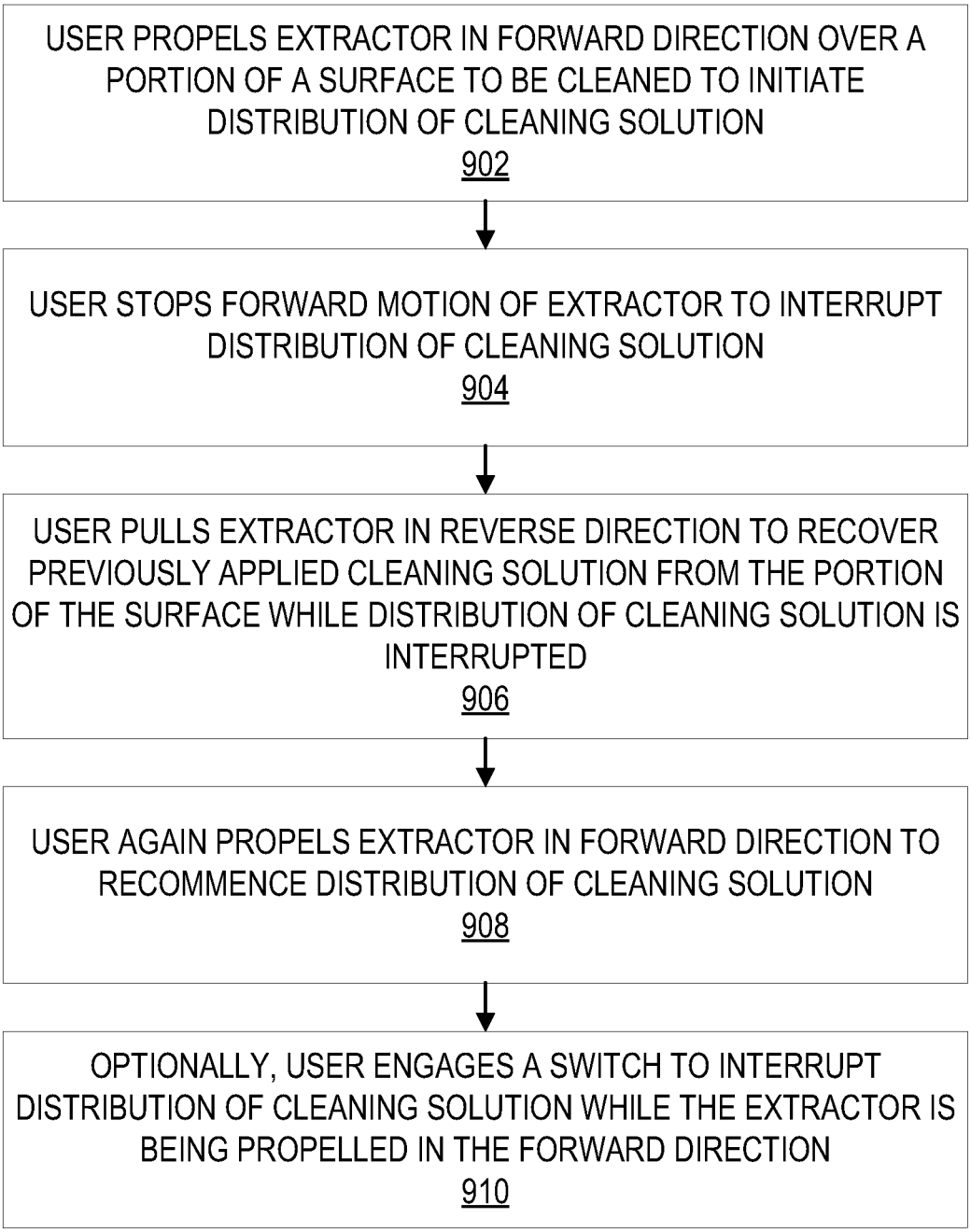
FIG. 10 provides a high level process flow for user operation of the surface cleaning device, in accordance with one embodiment.

In block 904 of FIG. 10, when the user stops the forward motion of the extractor, the encoder 510 stops transmitting the signal, which causes the controller 508 to interrupt the distribution of the cleaning solution. When the controller 508 determines from the encoder signal that the extractor is not being propelled forward, the controller 508 discontinues distribution of the solution, wherein the controller 508 operates the valve assembly 506 to close and interrupt the distribution of the cleaning solution to the surface.

In block 906 of FIG. 10, the user pulls the extractor 100 in a reverse direction back over the previously travelled portion of the surface to recover the previously applied cleaning solution. When the controller 508 determines from the encoder signal that the extractor is not being propelled forward, the controller does not initiate the distribution of the cleaning solution. Alternatively, or additionally, the rotation of the wheel 602 of the extractor 100 in the reverse direction is detected by the encoder 510 which transmits a second signal to the controller 508 and the controller determines reverse movement based on the second signal. In either event, in response to the controller determining that the extractor is not being propelled forward, the controller 508 controls the valve assembly 506 to remain closed to interrupt the distribution of the cleaning solution to the surface. Meanwhile, suction is generated by the suction source, and the previously applied cleaning solution is extracted from the surface along with dirt and debris while the brushes 404 continue to agitate and scrub the surface. In one alternative, the controller is configured to increase suction during reverse movement of the extractor.

In block 908 of FIG. 10, the user again propels the extractor 100 in the forward direction to recommence the distribution of cleaning solution to the surface. The user propels the extractor 100 in forward and reverse strokes to clean the surface, where the controller activates the distribution of cleaning solution during forward strokes and discontinues distribution of cleaning solution during reverse strokes. Optionally, as shown in block 910, the user engages a switch to discontinue the distribution of the cleaning solution while the extractor 100 is being propelled in the forward direction. For example, the user may wish to recover cleaning solution from a particular portion of the surface (e.g., the particular portion of the surface is still damp) to facilitate drying or may wish to concentrate solution extraction and/or agitation on a particular portion of the surface without the distribution of additional cleaning solution.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A surface cleaner comprising:

a base moveable along a surface;

a suction motor operable to generate an airflow;

a suction nozzle in fluid communication with the suction motor, the suction motor configured to generate the airflow through the suction nozzle;

an accelerometer configured to generate an accelerometer signal as a first signal based on user-initiated movement of the base along the surface in a forward direction and as a second signal based on user-initiated movement of the base along the surface in a rearward direction; and a controller in communication with the accelerometer and the suction motor operable to control the suction motor based on the accelerometer signal;

wherein the controller is configured to change a power to the suction motor to a forward power level based on the first signal during operation of the surface cleaner and to a rearward power level based on the second signal during operation of the surface cleaner, wherein the forward power level of the suction motor is less than the rearward power level of the suction motor.

2. The surface cleaner of claim 1, further comprising a handle configured to be gripped by a user, during a cleaning operation, to move the base, in a forward direction and a rearward direction during the cleaning operation, along the surface to be cleaned.

3. The surface cleaner of claim 1, the base further comprising a brush operatively connected to a brush motor, wherein the controller controls the brush motor based on the accelerometer signal during operation of the surface cleaner.

4. The surface cleaner of claim 3, wherein the controller increases speed of rotation of the brush based on the first signal during operation of the surface cleaner.

5. The surface cleaner of claim 3, wherein the controller decreases speed of rotation of the brush based on the second signal during operation of the surface cleaner.

6. The surface cleaner of claim 1, wherein the controller is configured to operate the suction motor to decrease the airflow through the suction nozzle based on the first signal during operation of the surface cleaner and increase the airflow through the suction nozzle based on the second signal during operation of the surface cleaner.

7. The surface cleaner of claim 1, wherein the accelerometer is configured to detect and measure rotational fluctuations of the suction motor.

8. The surface cleaner of claim 1 wherein at least one of the first signal and the second signal is indicative of a speed of movement of the base.

9. The surface cleaner of claim 1, further comprising:

a liquid distribution system including a supply tank and a distributor in fluid communication to deliver solution to the surface, and an operating component selected from the group consisting of a pump operable to deliver a cleaning fluid and an actuator operable to control a fluid valve;

wherein the accelerometer is further configured to generate the accelerometer signal based on user-initiated movement of the base along the surface;

wherein the controller is operatively connected to the liquid distribution system, the controller being configured to operate in a distributing mode during movement of the base and in a non-distributing mode during movement of the base based on the accelerometer signal during operation of the surface cleaner, wherein the controller changes from the distributing mode to the non-distributing mode independent of user interaction with the surface cleaner other than the user-initiated movement.

10. The surface cleaner of claim 9, wherein the accelerometer signal is indicative of a speed of movement of the base, and wherein the controller increases or decreases a rate of distribution of the solution through the fluid valve according to a respective increase or decrease of the speed of movement during operation of the surface cleaner.

11. The surface cleaner of claim 1, wherein the accelerometer signal is further indicative of the surface cleaner not moving, and wherein the controller is configured to operate the suction motor to interrupt or decrease the airflow through the suction nozzle when the controller determines that the surface cleaner is not moving for a predetermined amount of time.

12. The surface cleaner of claim 1 further comprising a handle pivotally coupled to the base pivotable between an upright storage position and a use position, wherein the accelerometer signal is further indicative of the handle being in the upright storage position and the use position, wherein the controller is configured to interrupt the airflow through the suction nozzle when the controller determines that the handle is in the upright storage position.

13. The surface cleaner of claim 1 further comprising a liquid distribution system including a supply tank and a distributor in fluid communication configured to deliver solution to the surface in a distributing mode when the first signal indicates user-initiated forward movement and to not deliver the solution to the surface in a non-distributing mode when the second signal indicates user-initiated reverse movement.

14. The surface cleaner of claim 1, the base further comprising a brushroll and an actuator operable to adjust a height of the brushroll from the surface, wherein the accelerometer signal is further indicative of the surface cleaner not moving, and wherein the controller is configured to control the actuator to increase the height of the brushroll from the surface based on the accelerometer signal indicating that the base is not moving along the surface for a predetermined amount of time and decrease the height of the brushroll from the surface based on the accelerometer signal indicating that the base has resumed movement.

15. The surface cleaner of claim 1, further comprising a liquid distribution system comprising a supply tank for holding liquid and a pump for dispensing the liquid from the supply tank, wherein the accelerometer signal is further indicative of the surface cleaner not moving, and wherein the controller is configured to control the pump to dispense the liquid based on the accelerometer signal indicating that the base is moving and not dispense the liquid based on the accelerometer signal indicating that the base is not moving.

16. The surface cleaner of claim 1, further comprising an actuator operable to control an airflow valve in fluid communication with the suction nozzle, wherein the controller is configured to control the actuator to decrease the airflow through the suction nozzle based on the first signal during operation of the surface cleaner and to increase the airflow through the suction nozzle based on the second signal during operation of the surface cleaner.

17. The surface cleaner of claim 1, further comprising an indicator, wherein the controller is configured to activate the indicator based on the accelerometer signal.

18. The surface cleaner of claim 17, wherein the indicator comprises at least one of a light, a display, or a speaker.

19. The surface cleaner of claim 17, wherein the indicator provides an indication or information associated with a parameter of the surface cleaner.

20. The surface cleaner of claim 19, wherein the parameter comprises at least one of:

an identified surface type or condition of the surface;

a status of an operating component of the surface cleaner;

a status of an airflow through the suction nozzle;

an indication of a speed and/or a height of a brushroll of the surface cleaner;

an indication of a position of a handle of the surface cleaner; or an indication that the surface cleaner is not moving for a predetermined amount of time.

21. The surface cleaner of claim 1, the base further comprising a brushroll and an actuator operable to adjust a height of the brushroll from the surface, wherein the accelerometer is configured to detect and measure vibrations produced by the brushroll in response to contacting a surface, and wherein the controller is configured to control the actuator to increase the height of the brushroll from the surface based on the accelerometer signal indicating increasing resistive force experienced by the brushroll on the surface.

* * * * *